US009922663B2

(12) United States Patent
Chen et al.

(10) Patent No.: US 9,922,663 B2
(45) Date of Patent: Mar. 20, 2018

(54) VOICE SIGNAL PROCESSING METHOD AND APPARATUS

(71) Applicant: Huawei Technologies Co., Ltd., Shenzhen (CN)

(72) Inventors: Rilin Chen, Shenzhen (CN); Deming Zhang, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 29 days.

(21) Appl. No.: 15/066,285

(22) Filed: Mar. 10, 2016

(65) Prior Publication Data

US 2016/0189728 A1 Jun. 30, 2016

Related U.S. Application Data

(63) Continuation of application No. PCT/CN2014/076375, filed on Apr. 28, 2014.

(30) Foreign Application Priority Data

Sep. 11, 2013 (CN) ..... 2013 1 0412886

(51) Int. Cl.
*G10L 21/028* (2013.01)
*G10L 21/0208* (2013.01)
(Continued)

(52) U.S. Cl.
CPC ..... *G10L 21/028* (2013.01); *G10L 21/0208* (2013.01); *H04R 3/005* (2013.01);
(Continued)

(58) Field of Classification Search
CPC ..... G10L 21/028; G10L 21/00; G10L 21/02; G10L 21/0208; G10L 21/0272;
(Continued)

(56) References Cited

U.S. PATENT DOCUMENTS 8,320,572 B2 * 11/2012 Liu ..... H04R 3/005 381/11
9,525,938 B2 * 12/2016 Deshpande ..... H04R 3/005
(Continued)

FOREIGN PATENT DOCUMENTS

CN 1953059 A 4/2007
CN 101593522 A 12/2009
(Continued)

OTHER PUBLICATIONS

Foreign Communication From a Counterpart Application, PCT Application No. PCT/CN2014/076375, English Translation of International Search Report dated Aug. 1, 2014, 3 pages.
(Continued)

*Primary Examiner* — Qi Han
(74) *Attorney, Agent, or Firm* — Conley Rose, P.C.

(57) ABSTRACT

A voice signal processing method and apparatus, which are used to process a voice signal collected by a microphone of a terminal in order to meet requirements of the terminal in different application modes for the voice signal generated after the processing. The method includes collecting at least two voice signals, determining a current application mode of a terminal, determining, according to the current application mode from the voice signals, voice signals corresponding to the current application mode, and performing, in a preset voice signal processing manner that matches the current application mode, beamforming processing on the corresponding voice signals.

20 Claims, 6 Drawing Sheets

(51) Int. Cl.
*H04R 3/00* (2006.01)
*G10L 21/0216* (2013.01)
*G10L 15/22* (2006.01)

(52) U.S. Cl.
CPC ..... *G10L 2015/228* (2013.01); *G10L 2021/02087* (2013.01); *G10L 2021/02166* (2013.01); *H04R 2499/11* (2013.01)

(58) Field of Classification Search
CPC ..... G10L 21/0363; G10L 2021/00; G10L 2021/02; G10L 2021/02087; G10L 2021/02165; G10L 2021/02166
USPC ..... 704/246, 250, 200, 203, 206, 259, 278
See application file for complete search history.

(56) References Cited

U.S. PATENT DOCUMENTS

2005/0239516 A1 10/2005 Gonopolskiy
2008/0312918 A1 12/2008 Kim
2009/0111507 A1* 4/2009 Chen ..... H04M 1/6008 455/550.1
2010/0017206 A1 1/2010 Kim et al.
2010/0172061 A1 7/2010 Gronwald
2011/0038486 A1* 2/2011 Beaucoup ..... H04R 3/005 381/56
2011/0124379 A1 5/2011 Chang
2012/0020489 A1 1/2012 Narita
2012/0051548 A1* 3/2012 Visser ..... G10L 21/0208 381/56
2012/0224715 A1 9/2012 Kikkeri
2013/0083942 A1* 4/2013 hgren ..... G01S 3/8006 381/92
2014/0172421 A1 6/2014 Liu et al.
2015/0142426 A1 5/2015 Song et al.

FOREIGN PATENT DOCUMENTS

CN 102227768 A 10/2011
CN 102300140 A 12/2011
CN 102708874 A 10/2012
CN 102801861 A 11/2012
EP 2324476 B1 8/2012
WO 2009010328 A1 1/2009
WO 2009086017 A1 7/2009
WO 2010039437 A1 4/2010
WO 2011129725 A1 10/2011

OTHER PUBLICATIONS

Foreign Communication From a Counterpart Application, PCT Application No. PCT/CN2014/076375, English Translation of Written Opinion dated Aug. 1, 2014, 6 pages.
Foreign Communication From a Counterpart Application, Chinese Application No. 201310412886.6, Chinese Office Action dated May 4, 2017, 6 pages.

* cited by examiner

VOICE SIGNAL PROCESSING METHOD AND APPARATUS

CROSS-REFERENCE TO RELATED APPLICATIONS

This application is a continuation of International Application No. PCT/CN2014/076375, filed on Apr. 28, 2014, which claims priority to Chinese Patent Application No. 201310412886.6, filed on Sep. 11, 2013, both of which are hereby incorporated by reference in their entireties.

TECHNICAL FIELD

The present disclosure relates to the field of microphone technologies, and in particular, to a voice signal processing method and apparatus.

BACKGROUND

As various mobile devices such as mobile phones are used widely, a usage environment and a usage scenario of a mobile device are further extended. Currently, in many usage environments and usage scenarios, the mobile device needs to collect a voice signal using a microphone of the mobile device.

A mobile device may simply use one microphone of the mobile device to collect a voice signal. However, a disadvantage of this manner lies in that: only single-channel noise reduction processing can be performed, and spatial filtering processing cannot be performed on the collected voice signal. Therefore, a capability of suppressing a noise signal such as an interfering voice included in the voice signal is extremely limited, and there is a problem that a noise reduction capability is insufficient in a case in which a noise signal is relatively large.

To perform noise reduction processing on an audio signal, a technology proposes that two microphones are used to respectively collect a voice signal and a noise signal and perform, based on the collected noise signal, noise reduction processing on the voice signal in order to ensure that a mobile device can obtain relatively high call quality in various usage environments and scenarios, and achieve a voice effect with low distortion and low noise.

Further, to obtain a better spatial sampling feature, a multi-microphone processing technology is further proposed. A principle of the technology is mainly to collect voice signals by separately using multiple microphones of a mobile device, and perform spatial filtering processing on the collected voice signals in order to obtain voice signals with relatively high quality. Because the technology may use a technology such as beamforming to perform spatial filtering processing on the collected voice signals, the technology has a stronger capability of suppressing a noise signal. A basic principle of the technology "beamforming" is that, after at least two received signals (for example, voice signals) are separately processed by an analog to digital converter (ADC), a digital processor uses digital signals output by the ADC to firm, according to a delay relationship or a phase shift relationship between the received signals that is obtained on the basis of a specific beam direction, a beam that points to the specific beam direction.

With improvement in functionality of a mobile device, a current mobile device can work in different application modes, where these application modes mainly include a handheld calling mode, a video calling mode, a hands-free conferencing mode, a recording mode in a non-communication scenario, and the like. Generally, a mobile device that works in different application modes always faces different requirements for a voice signal. However, the foregoing solutions in which a microphone is used to collect a voice signal do not propose how to process the voice signal collected by the microphone to enable a voice signal generated after the processing to meet requirements of the mobile device in different application modes.

SUMMARY

Embodiments of the present disclosure provide a voice signal processing method and apparatus, which are used to process a voice signal collected by a microphone of a terminal in order to meet requirements of the terminal in different application modes for a voice signal generated after the processing.

The embodiments of the present disclosure use the following technical solutions.

According to a first aspect, a voice signal processing method is provided, where the method includes collecting at least two voice signals, determining a current application mode of a terminal, determining, according to the current application mode from the at least two voice signals, voice signals corresponding to the current application mode, and performing, in a preset voice signal processing manner that matches the current application mode, beamforming processing on the corresponding voice signals.

With reference to the first aspect, in a first possible implementation manner, the terminal includes a first microphone array and a second microphone array, the first microphone array includes multiple microphones located at the bottom of the terminal, the second microphone array includes multiple microphones located on the top of the terminal, and the terminal further includes an earpiece located on the top of the terminal, and if the current application mode is a handheld calling mode, the determining, according to the current application mode from the at least two voice signals, voice signals corresponding to the current application mode further includes determining, according to the current application mode from the at least two voice signals, voice signals collected by each of the first microphone array and the second microphone array, and the performing, in a preset voice signal processing manner that matches the current application mode, beamforming processing on the corresponding voice signals further includes performing beamforming processing on the voice signals collected by the first microphone array such that a first beam generated after beamforming processing is performed on the voice signals collected by the first microphone array points to a direction directly in front of the bottom of the terminal, and performing beamforming processing on the voice signals collected by the second microphone array such that a second beam generated after beamforming processing is performed on the voice signals collected by the second microphone array points to a direction directly behind the top of the terminal, and the second beam forms null steering in a direction in which the earpiece of the terminal is located.

With reference to the first aspect, in a second possible implementation manner, the terminal includes a first microphone array and a second microphone array, the first microphone array includes multiple microphones located at the bottom of the terminal, and the second microphone array includes multiple microphones located on the top of the terminal, and if the current application mode is a video calling mode, the determining, according to the current application mode from the at least two voice signals, voice signals corresponding to the current application mode further includes, when it is determined, according to a current sound effect mode of the terminal, that the terminal does not need to synthesize voice signals that have a stereophonic sound effect, determining, according to the current application mode from the at least two voice signals, voice signals collected by the first microphone array.

With reference to the first aspect, in a third possible implementation manner, the terminal includes a first microphone array and a second microphone array, the first microphone array includes multiple microphones located at the bottom of the terminal, the second microphone array includes multiple microphones located on the top of the terminal, and an accelerometer is further disposed in the terminal, and if the current application mode is a video calling mode, the determining, according to the current application mode from the at least two voice signals, voice signals corresponding to the current application mode further includes, when it is determined, according to a current sound effect mode of the terminal, that the terminal needs to synthesize voice signals that have a stereophonic sound effect, according to the current application mode, determining, from the at least two voice signals according to a signal output by the accelerometer, the voice signals corresponding to the current application mode.

With reference to the third possible implementation manner of the first aspect, in a fourth possible implementation manner, the determining, from the at least two voice signals according to a signal output by the accelerometer, the voice signals corresponding to the current application mode further includes, if it is determined that a signal currently output by the accelerometer matches a predefined first signal, determining, from the at least two voice signals, voice signals currently collected by the second microphone array, where the predefined first signal is a signal output by the accelerometer when the terminal is in a state of being placed perpendicularly, and the terminal in the state of being placed perpendicularly meets a condition that an angle between a longitudinal axis of the terminal and a horizontal plane is 90 degrees, or if it is determined that a signal currently output by the accelerometer matches a predefined second signal, determining, from the at least two voice signals, voice signals currently collected by specific microphones, where the predefined second signal is a signal output by the accelerometer when the terminal is in a state of being placed horizontally, and the terminal in the state of being placed horizontally meets a condition that an angle between a longitudinal axis of the terminal and a horizontal plane is 0 degrees, and the specific microphones include at least one pair of microphones that are on a same horizontal line when the terminal is in the state of being placed horizontally, and each pair of microphones meets a condition that one microphone of the pair of microphones belongs to the first microphone array and the other microphone belongs to the second microphone array.

With reference to the third or the fourth possible implementation manner of the first aspect, in a fifth possible implementation manner, the performing, in a preset voice signal processing manner that matches the current application mode, beamforming processing on the corresponding voice signals further includes determining a current status of each camera disposed in the terminal, and performing, in a preset voice signal processing manner that matches both the current application mode and the current status of each camera, beamforming processing on the corresponding voice signals.

With reference to the first aspect, in a sixth possible implementation manner, the terminal includes a first microphone array and a second microphone array, the first microphone array includes multiple microphones located at the bottom of the terminal, the second microphone array includes multiple microphones located on the top of the terminal, and the terminal includes a speaker disposed on the top, and if the current application mode is a hands-free conferencing mode, the determining, according to the current application mode from the at least two voice signals, voice signals corresponding to the current application mode further includes determining, according to the current application mode from the at least two voice signals, voice signals collected by each of the first microphone array and the second microphone array.

With reference to the sixth possible implementation manner of the first aspect, in a seventh possible implementation manner, the performing, in a preset voice signal processing manner that matches the current application mode, beamforming processing on the corresponding voice signals further includes determining, according to a current sound effect mode of the terminal, whether the terminal needs to synthesize voice signals that have a surround sound effect, when it is determined that the terminal does not need to synthesize voice signals that have a surround sound effect, determining a part, currently used to play a voice signal, of the terminal, and when it is determined that the part is an earphone, performing beamforming processing on the corresponding voice signals such that a generated beam points to a location at which a common sound source of the corresponding voice signals is located, or a direction of a generated beam is consistent with a direction indicated by beam direction indication information entered into the terminal, where the location at which the common sound source is located is determined by performing, according to the corresponding voice signals, sound source tracking at a location at which a sound source is located, or when it is determined that the part is the speaker, performing beamforming processing on the corresponding voice signals such that a generated beam forms null steering in a direction in which the speaker is located.

With reference to the seventh possible implementation manner of the first aspect, in an eighth possible implementation manner, an accelerometer is disposed in the terminal, and the performing, in a preset voice signal processing manner that matches the current application mode, beamforming processing on the corresponding voice signals further includes when it is determined that the terminal needs to synthesize voice signals that have a surround sound effect and it is determined that a signal currently output by the accelerometer matches a predefined signal, selecting, from the corresponding voice signals, a voice signal collected by each of a pair of microphones currently distributed in a horizontal direction and a voice signal collected by each of a pair of microphones currently distributed in a perpendicular direction, where the pair of microphones currently distributed in a horizontal direction meets a condition that one microphone of the pair of microphones belongs to the first microphone array and the other microphone belongs to the second microphone array, and the pair of microphones currently distributed in a perpendicular direction belongs to the first microphone array or the second microphone array, performing differential processing on the selected voice signal collected by each of the pair of microphones distributed in a horizontal direction in order to obtain a first component of a first-order sound field, performing differential processing on the selected voice signal collected by each of the pair of microphones distributed in a perpendicular direction in order to obtain a second component of the first-order sound field, and obtaining a component of a zero-order sound field by performing equalization processing on the corresponding voice signals, and generating, using the first component of the first-order sound field, the second component of the first-order sound field, and the component of the zero-order sound field, different beams whose beam directions are consistent with specific directions; where the predefined signal is a signal output by the accelerometer when the terminal is in a state of being placed perpendicularly or in a state of being placed horizontally, the terminal in the state of being placed perpendicularly meets a condition that an angle between a longitudinal axis of the terminal and a horizontal plane is 90 degrees, and the terminal in the state of being placed horizontally meets a condition that an angle between the longitudinal axis of the terminal and the horizontal plane is 0 degrees.

With reference to the first aspect, in a ninth possible implementation manner, the terminal includes a first microphone array and a second microphone array, the first microphone array includes multiple microphones located at the bottom of the terminal, the second microphone array includes multiple microphones located on the top of the terminal, and an accelerometer is disposed in the terminal, and if the current application mode is a recording mode in a non-communication scenario, the determining, according to the current application mode from the at least two voice signals, voice signals corresponding to the current application mode further includes, when it is determined, according to a signal output by the accelerometer disposed in the terminal, that the terminal is currently in a state of being placed perpendicularly or in a state of being placed horizontally, determining, according to the current application mode from the at least two voice signals, voice signals currently collected by a pair of microphones that are currently on a same horizontal line, where the terminal in the state of being placed perpendicularly meets a condition that an angle between a longitudinal axis of the terminal and a horizontal plane is 90 degrees, and the terminal in the state of being placed horizontally meets a condition that an angle between the longitudinal axis of the terminal and the horizontal plane is 0 degrees.

According to a second aspect, a voice signal processing apparatus is provided, where the apparatus includes a collection unit configured to collect at least two voice signals, a mode determining unit configured to determine a current application mode of a terminal, a voice signal determining unit configured to determine, according to the current application mode from the at least two voice signals, voice signals corresponding to the current application mode, and a processing unit configured to perform, in a preset voice signal processing manner that matches the current application mode, beamforming processing on the corresponding voice signals.

With reference to the second aspect, in a first possible implementation manner, the terminal includes a first microphone array and a second microphone array, the first microphone array includes multiple microphones located at the bottom of the terminal, the second microphone array includes multiple microphones located on the top of the terminal, and the terminal further includes an earpiece located on the top of the terminal, and if the current application mode is a handheld calling mode, the voice signal determining unit is further configured to determine, according to the current application mode from the at least two voice signals, voice signals collected by each of the first microphone array and the second microphone array, and the processing unit is further configured to perform beamforming processing on the voice signals collected by the first microphone array such that a first beam generated after beamforming processing is performed on the voice signals collected by the first microphone array points to a direction directly in front of the bottom of the terminal, and perform beamforming processing on the voice signals collected by the second microphone array such that a second beam generated after beamforming processing is performed on the voice signals collected by the second microphone array points to a direction directly behind the top of the terminal, and the second beam forms null steering in a direction in which the earpiece of the terminal is located.

With reference to the second aspect, in a second possible implementation manner, the terminal includes a first microphone array and a second microphone array, the first microphone array includes multiple microphones located at the bottom of the terminal, and the second microphone array includes multiple microphones located on the top of the terminal, and if the current application mode is a video calling mode, the voice signal determining unit is further configured to, when it is determined, according to a current sound effect mode of the terminal, that the terminal does not need to synthesize voice signals that have a stereophonic sound effect, determine, according to the current application mode from the at least two voice signals, voice signals collected by the first microphone array.

With reference to the second aspect, in a third possible implementation manner, the terminal includes a first microphone array and a second microphone array, the first microphone array includes multiple microphones located at the bottom of the terminal, the second microphone array includes multiple microphones located on the top of the terminal, and an accelerometer is further disposed in the terminal, and if the current application mode is a video calling mode, the voice signal determining unit is further configured to, when it is determined, according to a current sound effect mode of the terminal, that the terminal needs to synthesize voice signals that have a stereophonic sound effect, according to the current application mode, determine, from the at least two voice signals according to a signal output by the accelerometer, the voice signals corresponding to the current application mode.

With reference to the third possible implementation manner of the second aspect, in a fourth possible implementation manner, the voice signal determining unit is further configured to, if it is determined that a signal currently output by the accelerometer matches a predefined first signal, determine, from the at least two voice signals, voice signals currently collected by the second microphone array, where the predefined first signal is a signal output by the accelerometer when the terminal is in a state of being placed perpendicularly, and the terminal in the state of being placed perpendicularly meets a condition that an angle between a longitudinal axis of the terminal and a horizontal plane is 90 degrees, or if it is determined that a signal currently output by the accelerometer matches a predefined second signal, determine, from the at least two voice signals, voice signals currently collected by specific microphones, where the predefined second signal is a signal output by the accelerometer when the terminal is in a state of being placed horizontally, and the terminal in the state of being placed horizontally meets a condition that an angle between a longitudinal axis of the terminal and a horizontal plane is 0 degrees, and the specific microphones include at least one pair of microphones that are on a same horizontal line when the terminal is in the state of being placed horizontally, and each pair of microphones meets a condition that one microphone of the pair of microphones belongs to the first microphone array and the other microphone belongs to the second microphone array.

With reference to the third or the fourth possible implementation manner of the second aspect, in a fifth possible implementation manner, the processing unit is further configured to determine a current status of each camera disposed in the terminal, and perform, in a preset voice signal processing manner that matches both the current application mode and the current status of each camera, beamforming processing on the corresponding voice signals.

With reference to the second aspect, in a sixth possible implementation manner, the terminal includes a first microphone array and a second microphone array, the first microphone array includes multiple microphones located at the bottom of the terminal, the second microphone array includes multiple microphones located on the top of the terminal, and the terminal includes a speaker disposed on the top, and if the current application mode is a hands-free conferencing mode, the voice signal determining unit is further configured to determine, according to the current application mode from the at least two voice signals, voice signals collected by each of the first microphone array and the second microphone array.

With reference to the sixth possible implementation manner of the second aspect, in a seventh possible implementation manner, the processing unit is further configured to determine, according to a current sound effect mode of the terminal, whether the terminal needs to synthesize voice signals that have a surround sound effect, when it is determined that the terminal does not need to synthesize voice signals that have a surround sound effect, determine a part, currently used to play a voice signal, of the terminal, and when it is determined that the part is an earphone, perform beamforming processing on the corresponding voice signals such that a generated beam points to a location at which a common sound source of the corresponding voice signals is located, or a direction of a generated beam is consistent with a direction indicated by beam direction indication information entered into the terminal, where the location at which the common sound source is located is determined by performing, according to the corresponding voice signals, sound source tracking at a location at which a sound source is located; or when it is determined that the part is the speaker, perform beamforming processing on the corresponding voice signals such that a generated beam forms null steering in a direction in which the speaker is located.

With reference to the seventh possible implementation manner of the second aspect, in an eighth possible implementation manner, an accelerometer is disposed in the terminal, and the processing unit is further configured to, when it is determined that the terminal needs to synthesize voice signals that have a surround sound effect and it is determined that a signal currently output by the accelerometer matches a predefined signal, select, from the corresponding voice signals, a voice signal collected by each of a pair of microphones currently distributed in a horizontal direction and a voice signal collected by each of a pair of microphones currently distributed in a perpendicular direction, where the pair of microphones currently distributed in a horizontal direction meets a condition that one microphone of the pair of microphones belongs to the first microphone array and the other microphone belongs to the second microphone array, and the pair of microphones currently distributed in a perpendicular direction belongs to the first microphone array or the second microphone array, perform differential processing on the selected voice signal collected by each of the pair of microphones distributed in a horizontal direction in order to obtain a first component of a first-order sound field, perform differential processing on the selected voice signal collected by each of the pair of microphones distributed in a perpendicular direction in order to obtain a second component of the first-order sound field, and obtain a component of a zero-order sound field by performing equalization processing on the corresponding voice signals, and generate, using the first component of the first-order sound field, the second component of the first-order sound field, and the component of the zero-order sound field, different beams whose beam directions are consistent with specific directions, where the predefined signal is a signal output by the accelerometer when the terminal is in a state of being placed perpendicularly or in a state of being placed horizontally, the terminal in the state of being placed perpendicularly meets a condition that an angle between a longitudinal axis of the terminal and a horizontal plane is 90 degrees, and the terminal in the state of being placed horizontally meets a condition that an angle between the longitudinal axis of the terminal and the horizontal plane is 0 degrees.

With reference to the second aspect, in a ninth possible implementation manner, the terminal includes a first microphone array and a second microphone array, the first microphone array includes multiple microphones located at the bottom of the terminal, the second microphone array includes multiple microphones located on the top of the terminal, and an accelerometer is disposed in the terminal, and if the current application mode is a recording mode in a non-communication scenario, the voice signal determining unit is further configured to, when it is determined, according to a signal output by the accelerometer disposed in the terminal, that the terminal is currently in a state of being placed perpendicularly or in a state of being placed horizontally, determine, according to the current application mode from the at least two voice signals, voice signals currently collected by a pair of microphones that are currently on a same horizontal line, where the terminal in the state of being placed perpendicularly meets a condition that an angle between a longitudinal axis of the terminal and a horizontal plane is 90 degrees, and the terminal in the state of being placed horizontally meets a condition that an angle between the longitudinal axis of the terminal and the horizontal plane is 0 degrees.

Beneficial effects of the embodiments of the present disclosure are as follows.

Using the foregoing solutions provided in the embodiments of the present disclosure, according to a current application mode of a terminal, voice signals corresponding to the current application mode are determined from at least two collected voice signals, and the determined voice signals are processed in a voice signal processing manner that matches the current application mode of the terminal such that both the determined voice signals and the voice signal processing manner can adapt to the current application mode of the terminal, and therefore requirements of the terminal in different application modes for a voice signal generated after processing can be met.

DESCRIPTION OF EMBODIMENTS

Before this disclosure, for different usage scenarios of a mobile device, a user may enable, in a manner of setting an application mode of the mobile device, the application mode of the mobile device to match a current usage scenario. For example, in a scenario in which the user initiates a call or receives a call using the mobile device, the user may set a mobile device to work in an application mode "handheld calling mode", and in a scenario in which the user makes a video call using the mobile device, the user may set the mobile device to work in an application mode "video calling mode".

Currently, more users of mobile devices want to obtain more rich sound effect experience in a process of using the mobile devices. For example, a user expects to enable, by enabling a stereophonic sound mode of a mobile device, the mobile device to differentiate different sound source locations within a 180-degree range centered at the mobile device in a process of performing recording using the mobile device such that a stereophonic sound effect can be generated when a recording is played back subsequently. For another example, the user expects that the mobile device can collect, when the mobile device works in a hands-free conferencing mode, voice signals from different sound sources within a 360-degree range centered at the mobile device, and generate and output a voice signal that can generate a surround sound effect.

In embodiments of the present disclosure, a voice signal processing method and apparatus are provided to process a voice signal collected by a microphone of a terminal that works in different application modes such that a voice signal generated after the processing can meet a requirement of the terminal in a corresponding application mode. The following describes the embodiments of the present disclosure with reference to the accompanying drawings of the specification. It should be understood that the embodiments described herein are merely used to describe and explain the present disclosure, but are not intended to limit the present disclosure. The embodiments of the present specification and features in the embodiments may be mutually combined in a case in which they do not conflict with each other.

Figure 1:
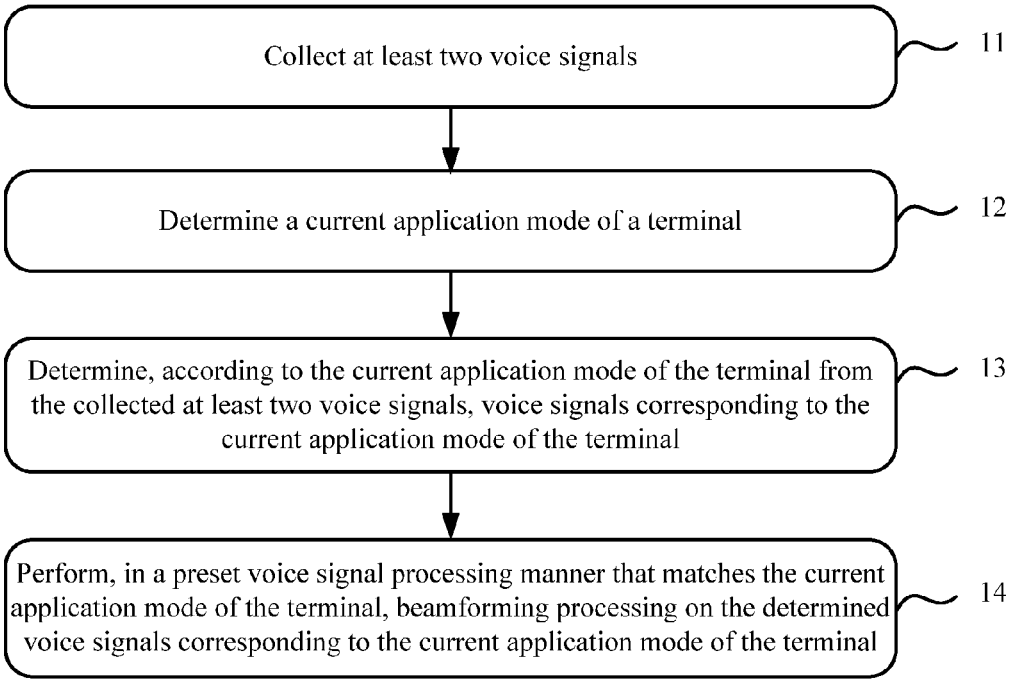
FIG. 1 is a flowchart of a specific implementation of a voice signal processing method according to an embodiment of the present disclosure.

First, an embodiment of the present disclosure provides a voice signal processing method shown in FIG. 1, and the method mainly includes the following steps.

Step 11: Collect at least two voice signals.

For example, that the method is executed by a terminal is used an example, and the terminal may collect a voice signal using each of at least two microphones disposed in the terminal.

Step 12: Determine a current application mode of the terminal.

For example, the current application mode of the terminal may be determined according to an application mode confirmation instruction that is entered into the terminal using an instruction input part (such as a touchscreen) of the terminal.

Figure 2:
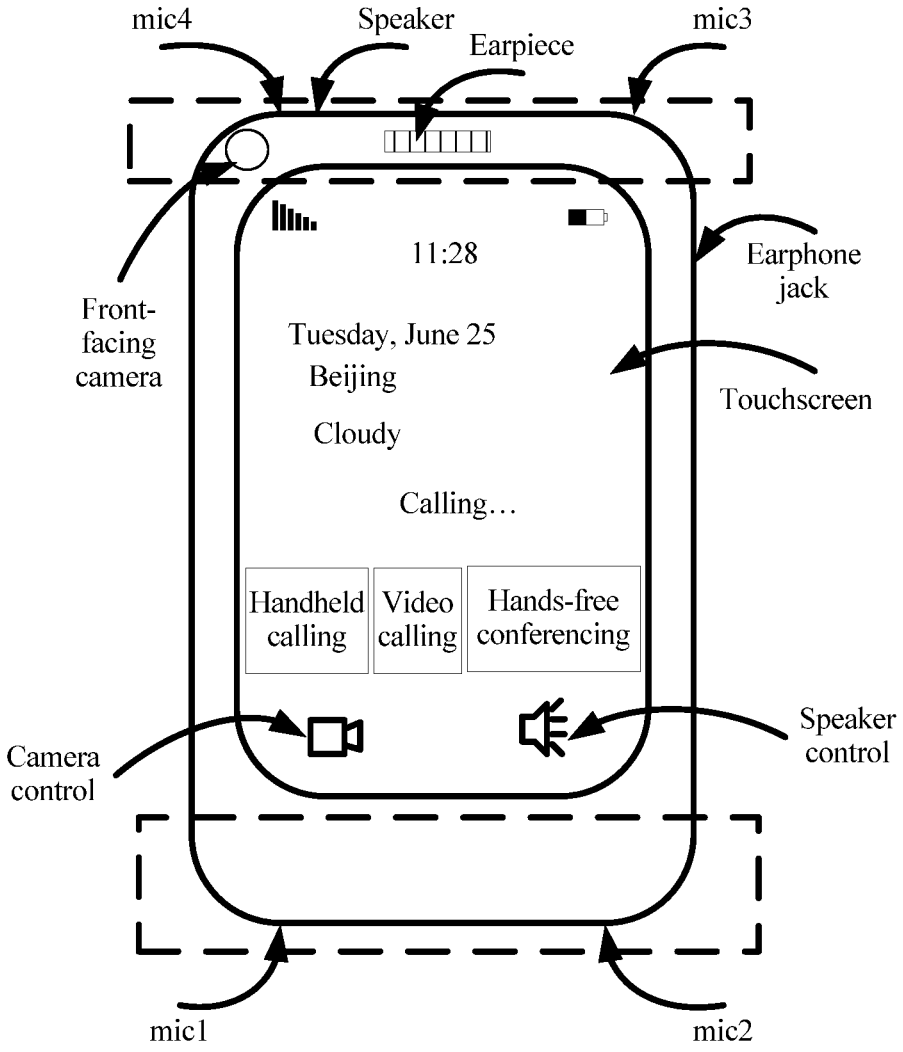
FIG. 2 is a schematic diagram of a mobile device in which four microphones are installed according to an embodiment of the present disclosure.

As shown in FIG. 2, FIG. 2 is a schematic diagram of a mobile device in which four microphones (which are mic1 to mic4 shown in FIG. 2) are installed according to an embodiment of the present disclosure. It may be learned from FIG. 2 that, on a touchscreen of the terminal, multiple application modes that can be selected by a user may be provided, including handheld calling mode (handheld calling), video calling mode (video calling), and hands-free conferencing mode (hands-free conferencing). After the user selects an application mode, the mobile device may be enabled to obtain an application mode confirmation instruction corresponding to the application mode selected by the user, and a current application mode of the terminal may be determined according to the application mode confirmation instruction.

Step 13: Determine, according to the current application mode of the terminal from the at least two voice signals collected by performing step 11, voice signals corresponding to the current application mode of the terminal.

Considering that requirements of the terminal in different application modes for a new voice signal that is generated according to the determined voice signal are different, in this embodiment of the present disclosure, different microphones may be predefined for the terminal in different application modes according to the requirements of the terminal in the different application modes for the new voice signal. For example, the mobile device shown in FIG. 2 is used as an example, and it may be predefined that microphones corresponding to the handheld calling mode of the mobile device are mic1 to mic4. Then, when it is determined, by performing step 11, that the current application mode of the mobile device is the handheld calling mode, voice signals collected by mic1 to mic4 of the mobile device may be selected. In this embodiment of the present disclosure, the mobile device shown in FIG. 2 may have a function of differentiating voice signals collected by different microphones.

The following further describes, for different current application modes of the terminal in multiple specific embodiments, how to determine, from the collected at least two voice signals, the voice signals corresponding to the current application mode of the terminal, which is not described herein.

Step 14: Perform, in a preset voice signal processing manner that matches the current application mode of the terminal, beamforming processing on the voice signals that are corresponding to the current application mode of the terminal and are determined by performing step 13.

The mobile device shown in FIG. 2 is still used as an example, and it is assumed that the current application mode of the mobile device is the handheld calling mode. Then, it may be learned by performing step 13 that the determined voice signals corresponding to the current application mode of the mobile device are voice signals currently collected by mic1 to mic4. Based on the voice signals currently collected by mic1 to mic4, considering that a first microphone array (including mic1 and mic2) located at the bottom of the mobile device is a microphone array close to a user's mouth, voice signals collected by the first microphone array are mainly acoustic wave signals made by the user, and a second microphone array (including mic3 and mic4) located on the top of the mobile device is a microphone array close to an earpiece of the mobile device and away from the user's mouth, and main voice signals collected by the second microphone array may be considered as some noise signals. Therefore, the voice signal processing manner used in step 14 may include the following content. Performing beamforming processing on the voice signals collected by the first microphone array such that a first beam generated after beamforming processing is performed on the voice signals collected by the first microphone array points to a direction directly in front of the bottom of the mobile device, that is, a location at which the user's mouth is located, and performing beamforming processing on the voice signals collected by the second microphone array such that a second beam generated after beamforming processing is performed on the voice signals collected by the second microphone array points to a direction directly behind the top of the mobile device, and the second beam forms null steering in a direction in which the earpiece of the mobile device is located.

The following describes meanings of "pointing to a direction directly in front of the bottom of the mobile device" and "pointing to a direction directly behind the top of the mobile device" using an example.

FIG. 2 is used as an example, and FIG. 2 is a schematic planar diagram of a front of the mobile device, and a surface opposite to the front is a rear (also referred to as a back) of the mobile device. A portion of the mobile device in an area enclosed by an upper dashed line box in FIG. 2 is the top of the mobile device, the top of the mobile device is a stereoscopic area, and the stereoscopic area includes both an area that is in the dashed line box and on the front of the mobile device and an area that is in the dashed line box and on the rear of the mobile device. A portion of the mobile device in an area enclosed by a lower dashed line box in FIG. 2 is the bottom of the mobile device, the bottom of the mobile device is also a stereoscopic area, and the stereoscopic area includes both an area that is in the dashed line box and on the front of the mobile device and an area that is in the dashed line box and on the rear of the mobile device. In terms of the mobile device shown in FIG. 2, "a direction directly in front of the bottom of the mobile device" refers to a direction perpendicular to an area that is enclosed by the lower dashed line box in FIG. 2 and is on the front of the mobile device, where the direction deviates from the page in which FIG. 2 is located, and "a direction directly behind the top of the mobile device" refers to a direction perpendicular to an area that is enclosed by the upper dashed line box in FIG. 2 and is on the front of the mobile device, where the direction deviates from the page in which FIG. 2 is located.

In this embodiment of the present disclosure, the first beam may be considered as an effective voice signal, and the second beam may be considered as a noise signal. On a basis that the first beam and the second beam are obtained, a voice signal with relatively high quality may be generated by performing voice enhancement processing on the first beam using the second beam. Optionally, in this embodiment of the present disclosure, voice enhancement processing may be further performed on the first beam using the second beam and a downlink signal (that is, a downlink signal obtained by a network side by decoding a voice signal that is sent by a current communications peer end of the mobile device) received by the mobile device, to generate a voice signal with relatively high quality.

Voice enhancement processing has already been a relatively mature technical means, which is not described in the present disclosure.

The following further describes, for different current application modes of the terminal in multiple specific embodiments, how to process, in the voice signal processing manner that matches the current application mode of the terminal, the determined voice signals corresponding to the current application mode of the terminal, which is not described herein.

It may be learned from the foregoing method provided in this embodiment of the present disclosure that, in the method, voice signals corresponding to a current application mode of a terminal are determined according to the current application mode, and the determined voice signals corresponding to the current application mode are processed in a voice signal processing manner that matches the current application mode of the terminal such that both the determined voice signals and the voice signal processing manner can adapt to the current application mode of the terminal, and therefore requirements of the terminal in different application modes for a voice signal generated after processing can be met.

The following describes in detail, using descriptions of multiple embodiments, when the terminal works in different application modes, how to select voice signals that match the current application mode of the terminal and how to process the selected voice signals.

It should be noted that, for ease of understanding, the following embodiments are all described using the mobile device shown in FIG. 2 as an example. Persons skilled in the art may understand that the solutions provided in the embodiments of the present disclosure may also be applied to another type of terminal, or a mobile device with another structure, and therefore the descriptions in the following embodiments should not be considered as a limitation to the solutions provided in the embodiments of the present disclosure.

In addition, it should be further noted that, for a process of collecting, selecting, processing, and uploading a voice signal by a mobile device in the following embodiments, reference may be made to FIG. 3.

Embodiment 1

In Embodiment 1, it is assumed that a mobile device currently works in a handheld calling mode. Generally, the mobile device that works in the handheld calling mode is usually in a state of being placed perpendicularly. The mobile device in the state of being placed perpendicularly meets a condition that an angle between a longitudinal axis of the mobile device and a horizontal plane is 90 degrees. Alternatively, the mobile device that works in the handheld calling mode may meet a condition that an angle between a longitudinal axis of the mobile device and a horizontal plane is greater than 60 degrees and less than or equal to 90 degrees.

When a current application mode of the mobile device is the handheld calling mode, it may be directly determined that voice signals collected by each of mic1 to mic4 that are disposed in the mobile device are voice signals corresponding to the handheld calling mode.

Then, beamforming processing is performed on the voice signals collected by each of mic1 and mic2 such that a first beam generated after beamforming processing is performed on the voice signals collected by each of mic1 and mic2 points to a normal direction of a connection line between mic1 and mic2, that is, points to a location at which a user's mouth is located. Meanwhile, beamforming processing is performed on the voice signals collected by each of mic3 and mic4 such that a second beam generated after beamforming processing is performed on the voice signals collected by each of mic3 and mic4 points to a normal direction of a connection line between mic3 and mic4, that is, points to a direction directly behind the top of the mobile device, and the second beam forms null steering in a direction in which an earpiece of the mobile device is located.

Further, on a basis that the first beam and the second beam are obtained, a voice signal with relatively high quality may be generated by performing voice enhancement processing on the first beam using the second beam. Optionally, in Embodiment 1, voice enhancement processing may be further performed on the first beam using the second beam and a downlink signal (that is, a downlink signal obtained by a network side by decoding a voice signal that is sent by a current communications peer end of the mobile device) received by the mobile device, to generate a voice signal with relatively high quality.

Embodiment 2

In Embodiment 2, it is assumed that a mobile device currently works in a video calling mode. Then, in Embodiment 2, in a process of determining voice signals corresponding to a current application mode of the mobile device from at least two voice signals collected by all microphones of the mobile device, it may be first determined whether the mobile device needs to synthesize voice signals that have a stereophonic sound effect. For example, it may be determined, according to a current sound effect mode of the mobile device, whether the mobile device needs to synthesize voice signals that have a stereophonic sound effect. The sound effect mode of the mobile device may be set by a user, and may include a stereophonic sound effect mode (that is, there is a need to synthesize voice signals that have a stereophonic sound effect), a surround sound effect mode (that is, there is a need to synthesize voice signals that have a surround sound effect), an ordinary sound effect mode (that is, there is neither a need to synthesize voice signals that have a stereophonic sound effect, nor a need to synthesize voice signals that have a surround sound effect), and the like.

If it is determined that the mobile device does not need to synthesize voice signals that have a stereophonic sound effect and the mobile device currently plays a voice signal using a speaker, voice signals currently collected by a first microphone array (that is, a microphone array relatively far away from the speaker) including mic1 and mic2 may be selected, and voice signals currently collected by a second microphone array (that is, a microphone array relatively close to the speaker) including mic3 and mic4 may be ignored. Alternatively, no matter whether the mobile device currently plays a voice signal using the speaker, voice signals currently collected by a first microphone array including mic1 and mic2 may be selected, and voice signals currently collected by a second microphone array including mic3 and mic4 may be ignored. Further, a manner for processing the selected voice signals may include, according to a voice and noise joint estimation technology in the prior art, performing noise estimation according to the selected voice signal collected by each of mic1 and mic2 in order to generate a voice signal with relatively small noise. Optionally, some echoes in the generated voice signal may be further eliminated according to an echo cancellation processing technology in the prior art using a voice signal sent by a video calling peer end and received by the mobile device.

However, in a case in which the mobile device needs to synthesize voice signals that have a stereophonic sound effect, in Embodiment 2, the voice signals corresponding to the current application mode of the mobile device may be determined, according to a signal output by an accelerometer disposed in the mobile device, from the at least two voice signals collected by all the microphones of the mobile device.

The following describes in detail, using the mobile device in a state of being placed perpendicularly or in a state of being placed horizontally, how to determine, according to the signal output by the accelerometer disposed in the mobile device, the voice signals corresponding to the current application mode of the mobile device from the at least two voice signals collected by all the microphones of the mobile device.

1. If it is determined that a signal currently output by the accelerometer matches a predefined first signal, voice signals currently collected by the second microphone array including mic3 and mic4 are selected from the at least two voice signals collected by all the microphones of the mobile device.

Figure 4:
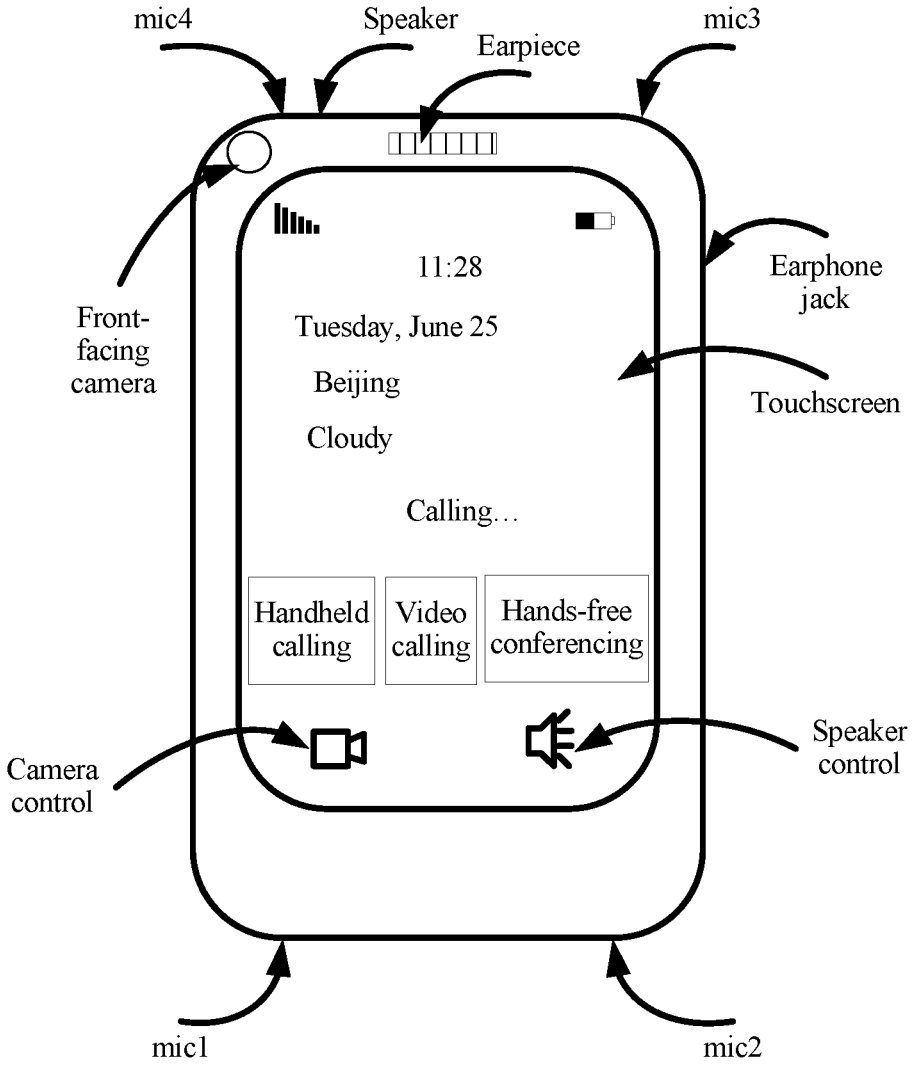
FIG. 4 is a schematic diagram of a mobile device in a state of being placed perpendicularly.

The predefined first signal described herein is a signal output by the accelerometer when the mobile device is in the state of being placed perpendicularly. Furthermore, for a schematic diagram of the mobile device in the state of being placed perpendicularly, reference may be made to FIG. 4 in this specification. The mobile device in the state of being placed perpendicularly meets a condition that an angle between a longitudinal axis of the mobile device and a horizontal plane is 90 degrees.

2. If it is determined that a signal currently output by the accelerometer matches a predefined second signal, voice signals currently collected by specific microphones are selected from the at least two voice signals collected by all the microphones of the mobile device.

The predefined second signal described herein is a signal output by the accelerometer when the mobile device is in the state of being placed horizontally. The mobile device in the state of being placed horizontally meets a condition that an angle between a longitudinal axis of the mobile device and a horizontal plane is 0 degrees. The foregoing specific microphones include at least one pair of microphones that are on a same horizontal line when the mobile device is in the state of being placed horizontally.

Figure 5:
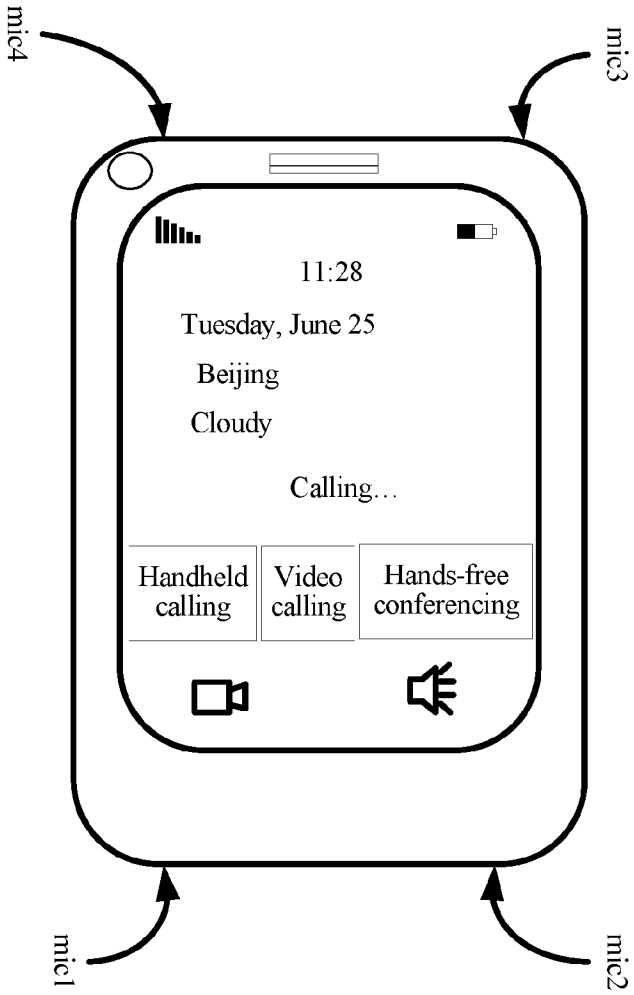
FIG. 5 is a schematic diagram of a mobile device in a state of being placed horizontally.

As shown in FIG. 5, FIG. 5 is a schematic diagram of the mobile device in the state of being placed horizontally. It may be learned from a manner for selecting voice signals in the foregoing second case that, voice signals currently collected by mic1 and mic4 that are currently on a same horizontal line in FIG. 5 may be selected, or voice signals currently collected by mic2 and mic3 that are currently on a same horizontal line may be selected.

In Embodiment 2, considering that when the mobile device works in the video calling mode, there may be several cases in which a front-facing camera is enabled, a rear-facing camera is enabled, and no camera is enabled, optionally, no matter whether the mobile device needs to synthesize voice signals that have a stereophonic sound effect, in Embodiment 2, after the voice signals corresponding to the current application mode of the mobile device are determined, a process of processing the determined voice signals in a preset voice signal processing manner that matches the current application mode of the mobile device may include the following sub step 1 and sub step 2.

Sub step 1: Determine a current status of each camera disposed in the mobile device.

Sub step 2: Perform, in a preset voice signal processing manner that matches both the current application mode of the mobile device and the current status of each camera, beamforming processing on the determined voice signals corresponding to the current application mode of the mobile device.

The following enumerates several typical cases in which the selected voice signals are processed according to the current status of each camera in the mobile device.

Case 1: The mobile device is in the state of being placed perpendicularly shown in FIG. 4, and the front-facing camera of the mobile device is currently enabled.

For case 1, if the selected voice signals are the voice signals collected by mic3 and mic4 that are currently on a same horizontal line, a left-channel voice signal may be generated using the voice signals collected by mic3 and mic4 and in a preset manner for generating a left-channel voice signal, and a right-channel voice signal may be generated using the voice signals collected by mic3 and mic4 and in a preset manner for generating a right-channel voice signal. Furthermore, the manner for generating a left-channel voice signal described herein may further include, using a voice signal collected by mic3 as a main microphone signal, performing a differential processing operation on the main microphone signal and a voice signal collected by mic4 in order to obtain a voice signal, that is, a left-channel voice signal. In a process of performing the differential processing operation, the main microphone signal serves as a minuend in the differential processing operation.

Similarly, the manner for generating a right-channel voice signal described herein may further include: using a voice signal collected by mic4 as a main microphone signal, performing a differential processing operation on the main microphone signal and a voice signal collected by mic3 in order to obtain a voice signal, that is, a right-channel voice signal. In a process of performing the differential processing operation, the main microphone signal serves as a minuend in the differential processing operation.

Figure 3:
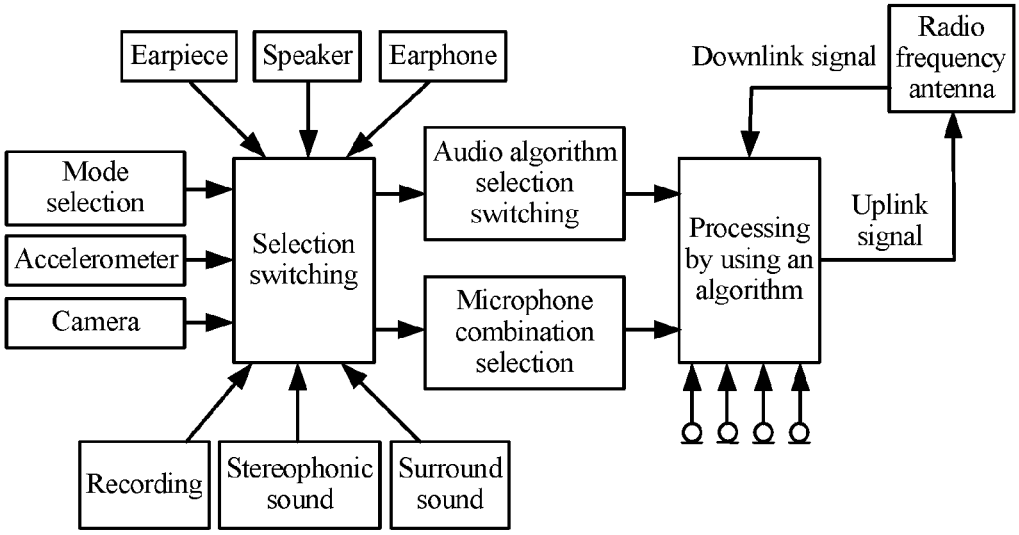
FIG. 3 is a schematic diagram of a process of collecting, selecting, processing, and uploading a voice signal by a mobile device according to an embodiment of the present disclosure.

Finally, the generated left-channel voice signal and right-channel voice signal are encoded as an uplink signal shown in FIG. 3, and the uplink signal is sent using a radio frequency antenna. Subsequently, after receiving the signal, a video calling peer of the mobile device may restore the foregoing left-channel voice signal and right-channel voice signal by decoding the signal.

Case 2: The mobile device is in the state of being placed perpendicularly shown in FIG. 4, and the rear-facing camera of the mobile device is currently enabled.

For case 2, if the selected voice signals are the voice signals collected by mic3 and mic4 that are currently on a same horizontal line, a left-channel voice signal may be generated using the voice signals collected by mic3 and mic4 and in a preset manner for generating a left-channel voice signal, and a right-channel voice signal may be generated using the voice signals collected by mic3 and mic4 and in a preset manner for generating a right-channel voice signal. Finally, the generated left-channel voice signal and right-channel voice signal are encoded as an uplink signal shown in FIG. 3, and the uplink signal is sent using a radio frequency antenna.

Furthermore, the manner for generating a left-channel voice signal described herein may further include, using a voice signal collected by mic4 as a main microphone signal, performing a differential processing operation on the main microphone signal and a voice signal collected by mic3 in order to obtain a voice signal, that is, a left-channel voice signal. In a process of performing the differential processing operation, the main microphone signal serves as a minuend in the differential processing operation.

Similarly, the manner for generating a right-channel voice signal described herein may further include, using a voice signal collected by mic3 as a main microphone signal, performing a differential processing operation on the main microphone signal and a voice signal collected by mic4 in order to obtain a voice signal, that is, a right-channel voice signal. In a process of performing the differential processing operation, the main microphone signal serves as a minuend in the differential processing operation.

Case 3: The mobile device is in the state of being placed horizontally shown in FIG. 5, and the front-facing camera of the mobile device is currently enabled.

For case 3, if the selected voice signals are the voice signals collected by mic1 and mic4 that are currently on a same horizontal line, a left-channel voice signal may be generated using the voice signals collected by mic1 and mic4 and in a preset manner for generating a left-channel voice signal, and a right-channel voice signal may be generated using the voice signals collected by mic1 and mic4 and in a preset manner for generating a right-channel voice signal. Finally, the generated left-channel voice signal and right-channel voice signal are encoded as an uplink signal shown in FIG. 3, and the uplink signal is sent using a radio frequency antenna.

Furthermore, the manner for generating a left-channel voice signal described herein may further include, using a voice signal collected by mic1 as a main microphone signal, performing a differential processing operation on the main microphone signal and a voice signal collected by mic4 in order to obtain a voice signal, that is, a left-channel voice signal. In a process of performing the differential processing operation, the main microphone signal serves as a minuend in the differential processing operation.

Similarly, the manner for generating a right-channel voice signal described herein may further include, using a voice signal collected by mic4 as a main microphone signal, performing a differential processing operation on the main microphone signal and a voice signal collected by mic1 in order to obtain a voice signal, that is, a right-channel voice signal. In a process of performing the differential processing operation, the main microphone signal serves as a minuend in the differential processing operation.

Case 4: The mobile device is in the state of being placed horizontally shown in FIG. 5, and the rear-facing camera of the mobile device is currently enabled.

For case 4, if the selected voice signals are the voice signals collected by mic1 and mic4 that are currently on a same horizontal line, a left-channel voice signal may be generated using the voice signals collected by mic4 and mic1 and in a preset manner for generating a left-channel voice signal, and a right-channel voice signal may be generated using the voice signals collected by mic4 and mic1 and in a preset manner for generating a right-channel voice signal. Finally, the generated left-channel voice signal and right-channel voice signal are encoded as an uplink signal shown in FIG. 3, and the uplink signal is sent using a radio frequency antenna.

Furthermore, the manner for generating a left-channel voice signal described herein may further include, using a voice signal collected by mic4 as a main microphone signal, performing a differential processing operation on the main microphone signal and a voice signal collected by mic1 in order to obtain a voice signal, that is, a left-channel voice signal. In a process of performing the differential processing operation, the main microphone signal serves as a minuend in the differential processing operation.

Similarly, the manner for generating a right-channel voice signal described herein may further include, using a voice signal collected by mic1 as a main microphone signal, performing a differential processing operation on the main microphone signal and a voice signal collected by mic4 in order to obtain a voice signal, that is, a right-channel voice signal. In a process of performing the differential processing operation, the main microphone signal serves as a minuend in the differential processing operation.

Case 5: The mobile device is in the state of being placed perpendicularly shown in FIG. 4, and no camera of the mobile device is currently enabled.

For case 5, if the selected voice signals are the voice signals collected by mic3 and mic4 that are currently on a same horizontal line, a left-channel voice signal may be generated using the voice signals collected by mic3 and mic4 and in a preset manner for generating a left-channel voice signal, and a right-channel voice signal may be generated using the voice signals collected by mic3 and mic4 and in a preset manner for generating a right-channel voice signal. Finally, the generated left-channel voice signal and right-channel voice signal are encoded as an uplink signal shown in FIG. 3, and the uplink signal is sent using a radio frequency antenna.

Furthermore, the manner for generating a left-channel voice signal described herein may further include, using a voice signal collected by mic3 as a main microphone signal, performing a differential processing operation on the main microphone signal and a voice signal collected by mic4 in order to obtain a voice signal, that is, a left-channel voice signal. In a process of performing the differential processing operation, the main microphone signal serves as a minuend in the differential processing operation.

Similarly, the manner for generating a right-channel voice signal described herein may further include, using a voice signal collected by mic4 as a main microphone signal, performing a differential processing operation on the main microphone signal and a voice signal collected by mic3 in order to obtain a voice signal, that is, a right-channel voice signal. In a process of performing the differential processing operation, the main microphone signal serves as a minuend in the differential processing operation.

Case 6: The mobile device is in the state of being placed horizontally shown in FIG. 5, and no camera of the mobile device is currently enabled.

For case 6, if the selected voice signals are the voice signals collected by mic1 and mic4 that are currently on a same horizontal line, a left-channel voice signal may be generated using the voice signals collected by mic1 and mic4 and in a preset manner for generating a left-channel voice signal, and a right-channel voice signal may be generated using the voice signals collected by mic1 and mic4 and in a preset manner for generating a right-channel voice signal. Finally, the generated left-channel voice signal and right-channel voice signal are encoded as an uplink signal shown in FIG. 3, and the uplink signal is sent using a radio frequency antenna.

Furthermore, the manner for generating a left-channel voice signal described herein may further include, using a voice signal collected by mic1 as a main microphone signal, performing a differential processing operation on the main microphone signal and a voice signal collected by mic4 in order to obtain a voice signal, that is, a left-channel voice signal. In a process of performing the differential processing operation, the main microphone signal serves as a minuend in the differential processing operation.

Similarly, the manner for generating a right-channel voice signal described herein may further include, using a voice signal collected by mic4 as a main microphone signal, performing a differential processing operation on the main microphone signal and a voice signal collected by mic1 in order to obtain a voice signal, that is, a right-channel voice signal. In a process of performing the differential processing operation, the main microphone signal serves as a minuend in the differential processing operation.

For the foregoing case 1 to case 6, after two microphone signals are selected, the two microphone signals may be processed using a first-order differential array processing method in order to obtain two cardioid beams that are orientated towards two directions: the left and the right; further, a left stereophonic voice signal and a right stereophonic voice signal may be obtained by performing low frequency compensation processing on the obtained beams, and the left and right stereophonic voice signals are sent after being encoded.

Embodiment 3

In Embodiment 3, it is assumed that a current application mode of a mobile device is a hands-free conferencing mode. Then, voice signals collected by all microphones included in the mobile device may be determined as voice signals corresponding to the hands-free conferencing mode.

In the hands-free conferencing mode, because the mobile device may probably need to synthesize voice signals that have a surround sound effect, in Embodiment 3, a process of performing, in a preset voice signal processing manner that matches the hands-free conferencing mode, beamforming processing on the determined voice signals corresponding to the hands-free conferencing mode may further include the following sub steps.

Sub step a: Determine, according to a current sound effect mode of the mobile device, whether the mobile device needs to synthesize voice signals that have a surround sound effect.

Sub step b: When it is determined that the mobile device does not need to synthesize voice signals that have a surround sound effect, perform beamforming processing on selected voice signals such that a direction of a generated beam is the same as a specific direction.

Sub step c: When it is determined that the mobile device needs to synthesize voice signals that have a surround sound effect, generate, by performing beamforming processing on selected voice signals, beams that point to different specific directions.

Alternatively, sub step c may be as follows.

First, when it is determined that the mobile device needs to synthesize voice signals that have a surround sound effect and it is determined that a signal currently output by an accelerometer disposed in the mobile device matches a predefined signal, a voice signal collected by each of a pair of microphones (for example, mic4 and mic1 shown in FIG. 6) currently distributed in a horizontal direction and a voice signal collected by each of a pair of microphones (for example, mic1 and mic2 shown in FIG. 6) currently distributed in a perpendicular direction are selected from the selected voice signals. Then, differential processing is performed on the selected voice signal collected by each of the pair of microphones currently distributed in a horizontal direction in order to obtain a first component of a first-order sound field (X shown in FIG. 6), differential processing is performed on the selected voice signal collected by each of the pair of microphones currently distributed in a perpendicular direction in order to obtain a second component of the first-order sound field (Y shown in FIG. 6), and a component of a zero-order sound field (W shown in FIG. 6) is obtained by performing equalization processing on the selected voice signals (that is, voice signals collected by mic1 to mic4), and finally, different beams whose beam directions are consistent with specific directions are generated using the obtained first component of the first-order sound field, the obtained second component of the first-order sound field, and the obtained component of the zero-order sound field.

Figure 6:
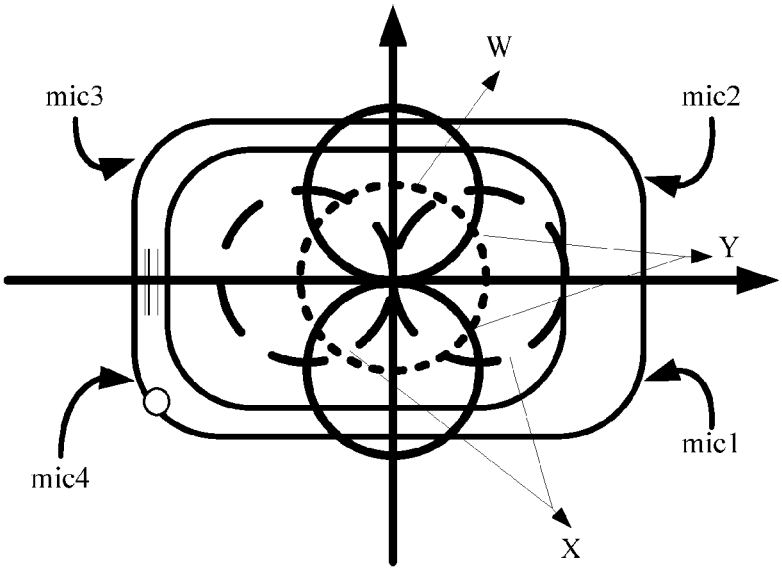
FIG. 6 is a schematic diagram of microphones of a mobile device that are arranged along a preset coordinate axis.

To clearly show X, Y, and W in the foregoing, content currently displayed on a screen of the mobile device is not shown in FIG. 6.

It should be noted that, because the foregoing three components are quadrature components of a sound field, a voice signal in any direction within a horizontal 360-degree range may be reconstructed using the foregoing three components. If the reconstructed voice signal is played back as an excitation signal of a playback system of the mobile device, a plane sound field may be rebuilt in order to obtain a surround sound effect. The foregoing predefined signal is a signal output by the accelerometer when the mobile device is in a state of being placed perpendicularly or in a state of being placed horizontally, the mobile device in the state of being placed perpendicularly meets a condition that an angle between a longitudinal axis of the mobile device and a horizontal plane is 90 degrees, and the mobile device in the state of being placed horizontally meets a condition that an angle between the longitudinal axis of the mobile device and the horizontal plane is 0 degrees.

In addition, it should be noted that an implementation manner of the foregoing sub step b may include:

1. determining a part, currently used to play a voice signal, of the mobile device, and 2. when it is determined that the part used to play a voice signal is an earphone, performing beamforming processing on the selected voice signals such that a generated beam points to a location at which a common sound source of the selected voice signals is located, or a direction of a generated beam is consistent with a direction indicated by beam direction indication information entered into the mobile device; or when it is determined that the part used to play a voice signal is a speaker disposed in the mobile device, performing beamforming processing on the selected voice signals such that a generated beam forms null steering in a direction in which the speaker is located.

The foregoing location at which the common sound source is located may be, but not limited to, determined by performing, according to the selected voice signals, sound source tracking at a location at which a sound source is located.

In this embodiment of the present disclosure, a user may enter beam direction indication information into the mobile device using an information input part such as a touchscreen of the mobile device. The beam direction indication information may be used to indicate a direction of a beam expected to be generated according to the selected voice signals. For example, in a scenario of a conversion between two persons, if a mobile device is located at a location between the two persons involved in the conversion, two main directions of beams may be set using a touchscreen of the mobile device, and the two main directions may be respectively orientated towards the foregoing two persons in order to achieve an objective of suppressing an interfering voice from another direction.

Embodiment 4

In Embodiment 4, it is assumed that a current application mode of a mobile device is a recording mode in a non-communication scenario. Then, a specific implementation manner for selecting voice signals corresponding to the current application mode of the mobile device may include: when it is determined, according to a signal output by an accelerometer disposed in the mobile device, that the mobile device is currently in a state of being placed perpendicularly or in a state of being placed horizontally, determining, according to the current application mode of the mobile device from voice signals collected by all microphones disposed in the mobile device, voice signals currently collected by a pair of microphones that are currently on a same horizontal line.

In Embodiment 4, for different current placement manners of the mobile device, selecting and processing of the voice signals may be classified into the following two cases.

Case 1: The mobile device is in the state of being placed perpendicularly shown in FIG. 4.

For case 1, if the selected voice signals are voice signals collected by mic3 and mic4 that are currently on a same horizontal line, a left-channel voice signal may be generated using the voice signals collected by mic3 and mic4 and in a preset manner for generating a left-channel voice signal, and a right-channel voice signal may be generated using the voice signals collected by mic3 and mic4 and in a preset manner for generating a right-channel voice signal.

Furthermore, the manner for generating a left-channel voice signal described herein may further include, using a voice signal collected by mic4 as a main microphone signal, performing a differential processing operation on the main microphone signal and a voice signal collected by mic3 in order to obtain a voice signal, that is, a left-channel voice signal. In a process of performing the differential processing operation, the main microphone signal serves as a minuend in the differential processing operation.

Similarly, the manner for generating a right-channel voice signal described herein may further include, using a voice signal collected by mic3 as a main microphone signal, performing a differential processing operation on the main microphone signal and a voice signal collected by mic4 in order to obtain a voice signal, that is, a right-channel voice signal. In a process of performing the differential processing operation, the main microphone signal serves as a minuend in the differential processing operation.

Case 2: The mobile device is in the state of being placed horizontally shown in FIG. 5.

For case 2, if the selected voice signals are voice signals collected by mic1 and mic4 that are currently on a same horizontal line, a left-channel voice signal may be generated using the voice signals collected by mic1 and mic4 and in a preset manner for generating a left-channel voice signal, and a right-channel voice signal may be generated using the voice signals collected by mic1 and mic4 and in a preset manner for generating a right-channel voice signal.

Furthermore, a process of generating the left-channel voice signal and the right-channel voice signal using the voice signals collected by mic1 and mic4 may include the following steps.

Step 1: Perform fast Fourier transform (FFT) transform after signal samples are intercepted by means of windowing.

It is assumed that both mic1 and mic4 are omnidirectional microphones, a voice signal collected by mic1 is $s_1$ (t), and a voice signal collected by mic4 is $s_4$ (t). Then, a specific implementation process of step 1 may include the following.

First, windowing is separately performed on $s_1$ (t) and $s_4$ (t) according to a sampling rate $f_s$ and a Hanning window with a length of N samples in order to respectively obtain the following two discrete voice signal sequences formed by N discrete signal samples:

$$s_1(l+1, \ldots, l+N/2, l+N/2+1, \ldots, l+N), \text{ and}$$

$$s_4(l+1, \ldots, l+N/2, l+N/2+1, \ldots, l+N).$$

Then, N-sample FFT transform is performed on the foregoing discrete voice signal sequences, and it may obtain that a frequency spectrum of an $i^{th}$ frequency bin in a $k^{th}$ frame of $s_1$(l+1, . . . , l+N/2, l+N/2+1, . . . , l+N) is $S_1$(k,i), and a frequency spectrum of an $i^{th}$ frequency bin in a $k^{th}$ frame of $s_4$(l+1, . . . , l+N/2, l+N/2+1, . . . , l+N) is $S_4$(k,i).

Step 2: Perform amplitude matching filtering.

To ensure signal amplitude consistency between the foregoing discrete voice signal sequences, amplitude equalization processing is first performed using an amplitude matching filter. If an amplitude matching filter with a filtering coefficient of $H_j$ is used, the following formulas exist $$S'_1(k,i)=H_1(k,i)S_1(k,i), \text{ and}$$

$$S'_4(k,i)=H_4(k,i)S_4(k,i).$$

Step 3: Perform differential processing to obtain output of a beam.

If d represents a distance between the two microphones, c represents a sound velocity, and $H_d$ represents a frequency compensation filter related to the distance d, output of two cardioid differential beams that are orientated towards two different directions may be respectively obtained using the following formulas, $$L(k, i) = \left(S'_1(k, i) - S'_4(k, i) \cdot \exp\left(-j\frac{2\pi i f_s d}{Nc}\right)\right)H_d(i), \text{ and}$$

$$R(k, i) = \left(S'_4(k, i) - S'_1(k, i) \cdot \exp\left(-j\frac{2\pi i f_s d}{Nc}\right)\right)H_d(i),$$

where

L(k,i) and R(k,i) represent different cardioid of differential beams.

Step 4: Perform inverse fast Fourier transform (IFFT) transform on L(k,i) and R(k,i) to obtain time-domain signals, where time-domain signals L(k,t) and R(k,t) in the $k^{th}$ frame are obtained.

Step 5: Perform overlap-add on the time-domain signals.

A left-channel signal L(t) and a right-channel signal R(t) of a stereophonic sound are obtained by means of overlap-add of the time-domain signals.

It may be learned from the foregoing embodiments and the voice signal processing method provided in the embodiments of the present disclosure that, an embodiment of the present disclosure first provides a microphone array configuration solution shown in FIG. 2. In the solution, microphones are located in four corners of the mobile device such that voice signal distortion caused by shielding of a hand may be avoided. Moreover, different microphone combinations in such a configuration manner may take account of requirements of the mobile device in different application modes for a generated voice signal. In addition, it may be further learned from the foregoing embodiments and the voice signal processing method provided in the embodiments of the present disclosure that, in this embodiment of the present disclosure, different microphone combinations may be configured in different application modes and related setting conditions, and a corresponding microphone array algorithm such as a beamforming algorithm may be used such that a noise reduction capability and a capability of suppressing an interfering voice in different application modes may be enhanced, a clearer and higher-fidelity voice signal can be obtained in different environments and scenarios, voice signals of multiple channels are fully used, and a waste of a voice signal is avoided. In particular, in a video calling mode, different dual-microphone configurations may be used to implement a recording or communication effect with a stereophonic sound in different scenarios. In a hands-free conferencing mode, all or some microphones may be used to implement recording in a plane sound field with reference to a corresponding algorithm such as a differential array algorithm in order to obtain a recording or communication effect with a plane surround sound.

It should be noted that, the voice signal processing method provided in the embodiments of the present disclosure is applicable to multiple types of terminals. For example, in addition to the terminal shown in FIG. 2, the method is also applicable to another terminal that includes a first microphone array and a second microphone array. The first microphone array includes multiple microphones located at the bottom of the terminal, and the second microphone array includes multiple microphones located on the top of the terminal.

Figure 7:
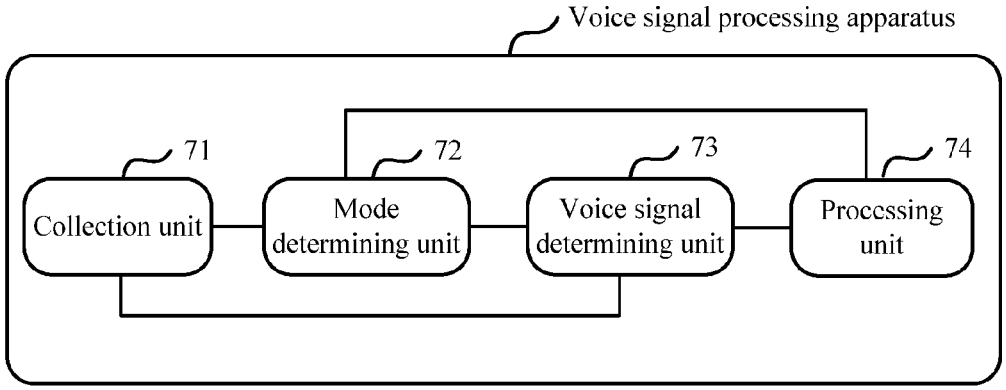
FIG. 7 is a schematic diagram of a specific structure of a voice signal processing apparatus according to an embodiment of the present disclosure.

Based on the same disclosure idea as that of the voice signal processing method provided in the embodiments of the present disclosure, an embodiment of the present disclosure further provides a voice signal processing apparatus. A schematic diagram of a specific structure of the apparatus is shown in FIG. 7, and the apparatus includes the following functional units. A collection unit 71 configured to collect at least two voice signals, a mode determining unit 72 configured to determine a current application mode of a terminal, a voice signal determining unit 73 configured to determine, according to the current application mode from the at least two voice signals collected by the collection unit 71, voice signals corresponding to the current application mode determined by the mode determining unit 72, and a processing unit 74 configured to perform, in a preset voice signal processing manner that matches the current application mode determined by the mode determining unit 72, beamforming processing on the voice signals determined by the voice signal determining unit 73.

For the terminal that includes different functional modules, the following further describes function implementation manners of the voice signal determining unit 73 and the processing unit 74 when the terminal is in different application modes.

1. It is assumed that the terminal includes a first microphone array and a second microphone array, the first microphone array includes multiple microphones located at the bottom of the terminal, the second microphone array includes multiple microphones located on the top of the terminal, and the terminal further includes an earpiece located on the top of the terminal. Then, if the current application mode of the terminal is a handheld calling mode, the voice signal determining unit 73 is further configured to determine, according to the current application mode from the at least two voice signals collected by the collection unit 71, voice signals collected by each of the first microphone array and the second microphone array, and the processing unit 74 is further configured to perform beamforming processing on the voice signals collected by the first microphone array such that a first beam generated after beamforming processing is performed on the voice signals collected by the first microphone array points to a direction directly in front of the bottom of the terminal, and perform beamforming processing on the voice signals collected by the second microphone array such that a second beam generated after beamforming processing is performed on the voice signals collected by the second microphone array points to a direction directly behind the top of the terminal, and the second beam forms null steering in a direction in which the earpiece of the terminal is located.

2. It is assumed that the terminal includes a first microphone array and a second microphone array, the first microphone array includes multiple microphones located at the bottom of the terminal, and the second microphone array includes multiple microphones located on the top of the terminal. Then, if the current application mode of the terminal is a video calling mode, the voice signal determining unit 73 is further configured to, when it is determined, according to a current sound effect mode of the terminal, that the terminal does not need to synthesize voice signals that have a stereophonic sound effect, determine, according to the current application mode from the at least two voice signals collected by the collection unit 71, voice signals collected by the first microphone array.

3. It is assumed that the terminal includes a first microphone array and a second microphone array, the first microphone array includes multiple microphones located at the bottom of the terminal, the second microphone array includes multiple microphones located on the top of the terminal, and an accelerometer is further disposed in the terminal. Then, if the current application mode of the terminal is a video calling mode, the voice signal determining unit 73 is further configured to, when it is determined, according to a current sound effect mode of the terminal, that the terminal needs to synthesize voice signals that have a stereophonic sound effect, according to the current application mode from the at least two voice signals collected by the collection unit 71, determine, according to a signal output by the accelerometer in the terminal, the voice signals corresponding to the current application mode.

For example, the voice signal determining unit 73 may be further configured to, if it is determined that a signal currently output by the accelerometer in the terminal matches a predefined first signal, determine, from the at least two voice signals collected by the collection unit 71, voice signals currently collected by the second microphone array, where the predefined first signal is a signal output by the accelerometer when the terminal is in a state of being placed perpendicularly, and the terminal in the state of being placed perpendicularly meets a condition that an angle between a longitudinal axis of the terminal and a horizontal plane is 90 degrees, or if it is determined that a signal currently output by the accelerometer matches a predefined second signal, determine, from the at least two voice signals collected by the collection unit 71, voice signals currently collected by specific microphones, where the predefined second signal is a signal output by the accelerometer when the terminal is in a state of being placed horizontally, and the terminal in the state of being placed horizontally meets a condition that an angle between a longitudinal axis of the terminal and a horizontal plane is 0 degrees.

The foregoing specific microphones include: at least one pair of microphones that are on a same horizontal line when the terminal is in the state of being placed horizontally, and each pair of microphones meets a condition that one microphone of the pair of microphones belongs to the first microphone array and the other microphone belongs to the second microphone array.

Optionally, based on the voice signals determined by the foregoing voice signal determining unit 73, the processing unit 74 may be further configured to determine a current status of each camera disposed in the terminal, and perform, in a preset voice signal processing manner that matches both the current application mode and the current status of each camera, beamforming processing on the corresponding voice signals.

4. The terminal includes a first microphone array and a second microphone array, the first microphone array includes multiple microphones located at the bottom of the terminal, the second microphone array includes multiple microphones located on the top of the terminal, and the terminal includes a speaker disposed on the top. If the current application mode of the terminal is a hands-free conferencing mode, the voice signal determining unit 73 may be further configured to determine, according to the current application mode from the at least two voice signals collected by the collection unit 71, voice signals collected by each of the first microphone array and the second microphone array.

Based on the function of the voice signal determining unit 73, the processing unit 74 may be further configured to determine, according to a current sound effect mode of the terminal, whether the terminal needs to synthesize voice signals that have a surround sound effect; when it is determined that the terminal does not need to synthesize voice signals that have a surround sound effect, determine a part, currently used to play a voice signal, of the terminal, and when it is determined that the part currently used to play a voice signal is an earphone, perform beamforming processing on the voice signals determined by the voice signal determining unit 73 such that a generated beam points to a location at which a common sound source of the voice signals determined by the voice signal determining unit 73 is located, or a direction of a generated beam is consistent with a direction indicated by beam direction indication information entered into the terminal, where the location at which the foregoing common sound source is located is determined by performing, according to the voice signals determined by the voice signal determining unit 73, sound source tracking at a location at which a sound source is located; or when it is determined that the part currently used to play a voice signal is the speaker, perform beamforming processing on the voice signals determined by the voice signal determining unit 73 such that a generated beam forms null steering in a direction in which the speaker is located.

Based on the function of the voice signal determining unit 73, if an accelerometer is further disposed in the terminal, the processing unit 74 may be further configured to, when it is determined that the terminal needs to synthesize voice signals that have a surround sound effect and it is determined that a signal currently output by the accelerometer matches a predefined signal, select, from the voice signals determined by the voice signal determining unit 73, a voice signal collected by each of a pair of microphones currently distributed in a horizontal direction and a voice signal collected by each of a pair of microphones currently distributed in a perpendicular direction, where the pair of microphones currently distributed in a horizontal direction meets a condition that one microphone of the pair of microphones belongs to the first microphone array and the other microphone belongs to the second microphone array, and the pair of microphones currently distributed in a perpendicular direction belongs to the first microphone array or the second microphone array, perform differential processing on the selected voice signal collected by each of the pair of microphones distributed in a horizontal direction in order to obtain a first component of a first-order sound field, perform differential processing on the selected voice signal collected by each of the pair of microphones distributed in a perpendicular direction in order to obtain a second component of the first-order sound field, and obtain a component of a zero-order sound field by performing equalization processing on the voice signals determined by the voice signal determining unit 73, and generate, using the first component of the first-order sound field, the second component of the first-order sound field, and the component of the zero-order sound field, different beams whose beam directions are consistent with specific directions, where the predefined signal is a signal output by the accelerometer when the terminal is in a state of being placed perpendicularly or in a state of being placed horizontally, the terminal in the state of being placed perpendicularly meets a condition that an angle between a longitudinal axis of the terminal and a horizontal plane is 90 degrees, and the terminal in the state of being placed horizontally meets a condition that an angle between the longitudinal axis of the terminal and the horizontal plane is 0 degrees.

5. The terminal includes a first microphone array and a second microphone array, the first microphone array includes multiple microphones located at the bottom of the terminal, the second microphone array includes multiple microphones located on the top of the terminal, and an accelerometer is disposed in the terminal. Then, if the current application mode is a recording mode in a non-communication scenario, the voice signal determining unit 73 is further configured to, when it is determined, according to a signal output by the accelerometer disposed in the terminal, that the terminal is currently in a state of being placed perpendicularly or in a state of being placed horizontally, determine, according to the current application mode from the at least two voice signals collected by the collection unit 71, voice signals currently collected by a pair of microphones that are currently on a same horizontal line, where the terminal in the state of being placed perpendicularly meets a condition that an angle between a longitudinal axis of the terminal and a horizontal plane is 90 degrees, and the terminal in the state of being placed horizontally meets a condition that an angle between the longitudinal axis of the terminal and the horizontal plane is 0 degrees.

Figure 8:
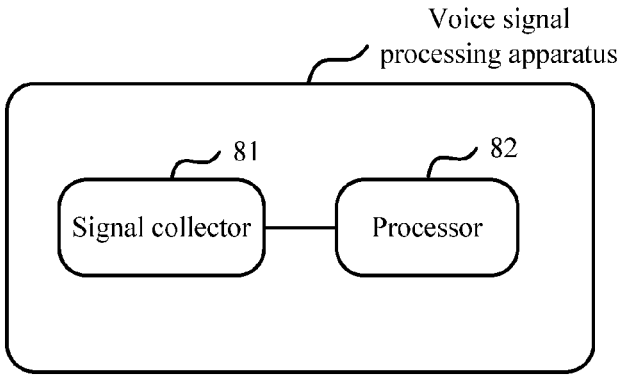
FIG. 8 is a schematic diagram of a specific structure of another voice signal processing apparatus according to an embodiment of the present disclosure.

An embodiment of the present disclosure further provides another voice signal processing apparatus. A schematic diagram of a specific structure of the apparatus is shown in FIG. 8, and the apparatus includes the following functional entities. A signal collector 81 configured to collect at least two voice signals, and a processor 82 configured to determine a current application mode of a terminal, determine, according to the current application mode from the at least two voice signals, voice signals corresponding to the current application mode, and perform, in a preset voice signal processing manner that matches the current application mode, beamforming processing on the corresponding voice signals.

For the terminal that includes different functional modules, the following further describes function implementation manners of the signal collector 81 and the processor 82 when the terminal is in different application modes.

1. The terminal includes a first microphone array and a second microphone array, the first microphone array includes multiple microphones located at the bottom of the terminal, the second microphone array includes multiple microphones located on the top of the terminal, and the terminal further includes an earpiece located on the top of the terminal. Then, if the current application mode is a handheld calling mode, that the processor 82 is further configured to determine, according to the current application mode from the at least two voice signals collected by the signal collector, voice signals collected by each of the first microphone array and the second microphone array, and perform beamforming processing on the voice signals collected by the first microphone array such that a first beam generated after beamforming processing is performed on the voice signals collected by the first microphone array points to a direction directly in front of the bottom of the terminal, and performing beamforming processing on the voice signals collected by the second microphone array such that a second beam generated after beamforming processing is performed on the voice signals collected by the second microphone array points to a direction directly behind the top of the terminal, and the second beam forms null steering in a direction in which the earpiece of the terminal is located.

2. The terminal includes a first microphone array and a second microphone array, the first microphone array includes multiple microphones located at the bottom of the terminal, and the second microphone array includes multiple microphones located on the top of the terminal. Then, if the current application mode is a video calling mode, that the processor 82 determines, according to the current application mode from the at least two voice signals collected by the signal collector, the voice signals corresponding to the current application mode further includes, when it is determined, according to a current sound effect mode of the terminal, that the terminal does not need to synthesize voice signals that have a surround sound effect, determining, according to the current application mode from the at least two voice signals collected by the signal collector, voice signals collected by the first microphone array.

3. The terminal includes a first microphone array and a second microphone array, the first microphone array includes multiple microphones located at the bottom of the terminal, the second microphone array includes multiple microphones located on the top of the terminal, and an accelerometer is further disposed in the terminal. Then, if the current application mode is a video calling mode, that the processor 82 determines, according to the current application mode from the at least two voice signals collected by the signal collector, the voice signals corresponding to the current application mode further includes, when it is determined, according to a current sound effect mode of the terminal, that the terminal needs to synthesize voice signals that have a stereophonic sound effect, according to the current application mode from the at least two voice signals collected by the signal collector, determining, according to a signal output by the accelerometer, the voice signals corresponding to the current application mode.

Optionally, that the processor 82 determines, according to the signal output by the accelerometer, the voice signals corresponding to the current application mode from the at least two voice signals collected by the signal collector may further include, if it is determined that a signal currently output by the accelerometer matches a predefined first signal, determining, from the at least two voice signals collected by the signal collector, voice signals currently collected by the second microphone array, where the predefined first signal is a signal output by the accelerometer when the terminal is in a state of being placed perpendicularly, and the terminal in the state of being placed perpendicularly meets a condition that an angle between a longitudinal axis of the terminal and a horizontal plane is 90 degrees, or if it is determined that a signal currently output by the accelerometer matches a predefined second signal, determining, from the at least two voice signals collected by the signal collector, voice signals currently collected by specific microphones, where the predefined second signal is a signal output by the accelerometer when the terminal is in a state of being placed horizontally, and the terminal in the state of being placed horizontally meets a condition that an angle between a longitudinal axis of the terminal and a horizontal plane is 0 degrees.

The foregoing specific microphones include at least one pair of microphones that are on a same horizontal line when the terminal is in the state of being placed horizontally, and each pair of microphones meets a condition that one microphone of the pair of microphones belongs to the first microphone array and the other microphone belongs to the second microphone array.

Optionally, that the processor 82 performs, in the preset voice signal processing manner that matches the current application mode, beamforming processing on the voice signals determined by the processor 82 further includes determining a current status of each camera disposed in the terminal, and performing, in a preset voice signal processing manner that matches both the current application mode and the current status of each camera, beamforming processing on the voice signals determined by the processor 82.

4. The terminal includes a first microphone array and a second microphone array, the first microphone array includes multiple microphones located at the bottom of the terminal, the second microphone array includes multiple microphones located on the top of the terminal, and the terminal includes a speaker disposed on the top. Then, if the current application mode is a hands-free conferencing mode, that the processor 82 determines, according to the current application mode from the at least two voice signals collected by the signal collector, the voice signals corresponding to the current application mode may further include determining, according to the current application mode from the at least two voice signals collected by the signal collector, voice signals collected by each of the first microphone array and the second microphone array.

Optionally, that the processor 82 performs, in the preset voice signal processing manner that matches the current application mode, beamforming processing on the voice signals determined by the processor 82 further includes determining, according to a current sound effect mode of the terminal, whether the terminal needs to synthesize voice signals that have a surround sound effect, when it is determined that the terminal does not need to synthesize voice signals that have a surround sound effect, determining a part, currently used to play a voice signal, of the terminal, and when it is determined that the part is an earphone, performing beamforming processing on the voice signals determined by the processor 82 such that a generated beam points to a location at which a common sound source of the voice signals determined by the processor 82 is located, or a direction of a generated beam is consistent with a direction indicated by beam direction indication information entered into the terminal, where the location at which the common sound source is located is determined by performing, according to the voice signals determined by the processor 82, sound source tracking at a location at which a sound source is located, or when it is determined that the part is the speaker, performing beamforming processing on the voice signals determined by the processor 82 such that a generated beam forms null steering in a direction in which the speaker is located.

Optionally, if an accelerometer is further disposed in the terminal, that the processor 82 performs, in the preset voice signal processing manner that matches the current application mode, beamforming processing on the voice signals determined by the processor 82 may further include, when it is determined that the terminal needs to synthesize voice signals that have a surround sound effect and it is determined that a signal currently output by the accelerometer matches a predefined signal, selecting, from the voice signals determined by the processor 82, a voice signal collected by each of a pair of microphones currently distributed in a horizontal direction and a voice signal collected by each of a pair of microphones currently distributed in a perpendicular direction, where the pair of microphones currently distributed in a horizontal direction meets a condition that one microphone of the pair of microphones belongs to the first microphone array and the other microphone belongs to the second microphone array, and the pair of microphones currently distributed in a perpendicular direction belongs to the first microphone array or the second microphone array, performing differential processing on the selected voice signal collected by each of the pair of microphones distributed in a horizontal direction in order to obtain a first component of a first-order sound field, performing differential processing on the selected voice signal collected by each of the pair of microphones distributed in a perpendicular direction in order to obtain a second component of the first-order sound field, and obtaining a component of a zero-order sound field by performing equalization processing on the voice signals determined by the processor 82, and generating, using the first component of the first-order sound field, the second component of the first-order sound field, and the component of the zero-order sound field, different beams whose beam directions are consistent with specific directions, where the predefined signal is a signal output by the accelerometer when the terminal is in a state of being placed perpendicularly or in a state of being placed horizontally, the terminal in the state of being placed perpendicularly meets a condition that an angle between a longitudinal axis of the terminal and a horizontal plane is 90 degrees, and the terminal in the state of being placed horizontally meets a condition that an angle between the longitudinal axis of the terminal and the horizontal plane is 0 degrees.

5. The terminal includes a first microphone array and a second microphone array, the first microphone array includes multiple microphones located at the bottom of the terminal, the second microphone array includes multiple microphones located on the top of the terminal, and an accelerometer is disposed in the terminal. Then, if the current application mode is a recording mode in a non-communication scenario, that the processor 82 determines, according to the current application mode from the at least two voice signals collected by the signal collector, the voice signals corresponding to the current application mode further includes, when it is determined, according to a signal output by the accelerometer disposed in the terminal, that the terminal is currently in a state of being placed perpendicularly or in a state of being placed horizontally, determining, according to the current application mode from the at least two voice signals collected by the signal collector, voice signals currently collected by a pair of microphones that are currently on a same horizontal line, where the terminal in the state of being placed perpendicularly meets a condition that an angle between a longitudinal axis of the terminal and a horizontal plane is 90 degrees, and the terminal in the state of being placed horizontally meets a condition that an angle between the longitudinal axis of the terminal and the horizontal plane is 0 degrees.

Persons skilled in the art should understand that the embodiments of the present disclosure may be provided as a method, a system, or a computer program product. Therefore, the present disclosure may use a form of hardware only embodiments, software only embodiments, or embodiments with a combination of software and hardware. Moreover, the present disclosure may use a form of a computer program product that is implemented on one or more computer-usable storage media (including but not limited to a disk memory, a compact disc read-only memory (CD-ROM), an optical memory, and the like) that include computer-usable program code.

The present disclosure is described with reference to the flowcharts and/or block diagrams of the method, the device (system), and the computer program product according to the embodiments of the present disclosure. It should be understood that computer program instructions may be used to implement each process and/or each block in the flowcharts and/or the block diagrams and a combination of a process and/or a block in the flowcharts and/or the block diagrams. These computer program instructions may be provided for a general-purpose computer, a dedicated computer, an embedded processor, or a processor of any other programmable data processing device to generate a machine such that the instructions executed by a computer or a processor of any other programmable data processing device generate an apparatus for implementing a specific function in one or more processes in the flowcharts and/or in one or more blocks in the block diagrams.

These computer program instructions may also be stored in a computer readable memory that can instruct the computer or any other programmable data processing device to work in a specific manner such that the instructions stored in the computer readable memory generate an artifact that includes an instruction apparatus. The instruction apparatus implements a specific function in one or more processes in the flowcharts and/or in one or more blocks in the block diagrams.

These computer program instructions may also be loaded onto a computer or any other programmable data processing device such that a series of operations and steps are performed on the computer or the any other programmable device, to generate computer-implemented processing. Therefore, the instructions executed on the computer or the any other programmable device provide steps for implementing a specific function in one or more processes in the flowcharts and/or in one or more blocks in the block diagrams.

Although some exemplary embodiments of the present disclosure have been described, persons skilled in the art can make changes and modifications to these embodiments once they learn the basic inventive concept. Therefore, the following claims are intended to be construed as to cover the exemplary embodiments and all changes and modifications falling within the scope of the present disclosure.

Obviously, persons skilled in the art can make various modifications and variations to the present disclosure without departing from the scope of the present disclosure. The present disclosure is intended to cover these modifications and variations provided that they fall within the protection scope defined by the following claims and their equivalent technologies.

What is claimed is:

1. A voice signal processing method, comprising:

collecting, by a first microphone array and a second microphone array of a terminal that includes a speaker at a top of the terminal, at least two voice signals, wherein the first microphone array comprises multiple microphones located at a bottom of the terminal, and wherein the second microphone array comprises multiple microphones located at the top of the terminal;

determining a current application mode of the terminal, wherein the current application mode corresponds to a handheld calling mode, a video calling mode, a hands-free conferencing mode, or a recording mode in a non-communication scenario;

determining, according to the current application mode and from the at least two voice signals, a plurality of voice signals corresponding to the current application mode, wherein when the current application mode is the hands-free conferencing mode, determining the plurality of voice signals comprises determining voice signals collected by the first microphone array and voice signals collected from the second microphone array; and after determining the plurality of voice signals corresponding to the current application mode, performing, in a preset voice signal processing manner that matches the current application mode, beamforming processing on the plurality of voice signals corresponding to the current application mode.

2. The method according to claim 1, wherein the terminal further comprises an earpiece located on the top of the terminal, wherein when the current application mode is the handheld calling model;

determining the plurality of voice signals corresponding to the current application mode comprises determining the voice signals collected by the first microphone array and the voice signals collected by the second microphone array; and performing, in the preset voice signal processing manner that matches the current application mode, beamforming processing on the plurality of voice signals corresponding to the current application mode comprises:

performing beamforming processing on the voice signals collected by the first microphone array such that a first beam generated after beamforming processing is performed on the voice signals collected by the first microphone array points to a direction directly in front of the bottom of the terminal; and performing beamforming processing on the voice signals collected by the second microphone array such that a second beam generated after beamforming processing is performed on the voice signals collected by the second microphone array points to a direction directly behind the top of the terminal, wherein the second beam forms null steering in a direction in which the earpiece of the terminal is located.

3. The method according to claim 1, wherein when the current application mode is the video calling mode, determining the plurality of voice signals corresponding to the current application mode comprises determining the voice signals collected by the first microphone array when the terminal does not need to synthesize voice signals that have a stereophonic sound effect.

4. The method according to claim 1, wherein an accelerometer is further disposed in the terminal, and wherein when the current application mode is the video calling mode, determining the plurality of voice signals corresponding to the current application mode comprises determining, from the at least two voice signals according to a signal output by the accelerometer, the plurality of voice signals corresponding to the current application mode when the terminal needs to synthesize voice signals that have a stereophonic sound effect.

5. The method according to claim 4, wherein determining the plurality of voice signals corresponding to the current application mode comprises:

determining, from the at least two voice signals, voice signals currently collected by the second microphone array when the signal currently output by the accelerometer matches a predefined first signal, wherein the predefined first signal is the signal output by the accelerometer when the terminal is in a state of being placed perpendicularly, and wherein the terminal in the state of being placed perpendicularly meets a condition that an angle between a longitudinal axis of the terminal and a horizontal plane is 90 degrees; and determining, from the at least two voice signals, voice signals currently collected by specific microphones when the signal currently output by the accelerometer matches a predefined second signal, wherein the predefined second signal is the signal output by the accelerometer when the terminal is in a state of being placed horizontally, and wherein the terminal in the state of being placed horizontally meets a condition that an angle between the longitudinal axis of the terminal and the horizontal plane is 0 degrees, wherein the specific microphones comprise at least one pair of microphones that are on a same horizontal line when the terminal is in the state of being placed horizontally, and wherein each pair of microphones meets a condition that one microphone of the pair of microphones belongs to the first microphone array and the other microphone belongs to the second microphone array.

6. The method according to claim 4, wherein performing beamforming processing on the plurality of voice signals corresponding to the current application mode comprises:

determining a current status of each camera disposed in the terminal; and performing, in the preset voice signal processing manner that matches both the current application mode and the current status of each camera, beamforming processing on the plurality of voice signals corresponding to the current application node.

7. The method according to claim 1, wherein performing beamforming processing on the plurality of voice signals corresponding to the current application mode comprises:

determining, according to a current sound effect mode of the terminal, whether the terminal needs to synthesize voice signals that have a surround sound effect;

determining a part of the terminal when the terminal does not need to synthesize voice signals that have the surround sound effect, wherein the part is currently used to play the voice signal;

performing beamforming processing on the plurality of voice signals corresponding to the current application mode such that a generated beam points to a location at which a common sound source of the plurality of voice signals corresponding to the current application mode is located, or a direction of the generated beam is consistent with a direction indicated by beam direction indication information entered into the terminal when the part is an earphone, and wherein the location at which the common sound source is located is determined by performing, according to the plurality of voice signals corresponding to the current application mode, sound source tracking at the location at which the sound source is located; and performing beamforming processing on the plurality of voice signals corresponding to the current application mode such that the generated beam forms null steering in a direction in which the speaker is located when the part is the speaker.

8. The method according to claim 7, wherein an accelerometer is disposed in the terminal, and wherein performing beamforming processing on the plurality of voice signals corresponding to the current application mode further comprises:

selecting, from the plurality of voice signals corresponding to the current application mode, a voice signal collected by each of a pair of microphones currently distributed in a horizontal direction and a voice signal collected by each of a pair of microphones currently distributed in a perpendicular direction when the terminal needs to synthesize voice signals that have the surround sound effect and when a signal currently output by the accelerometer matches a predefined signal, wherein the pair of microphones currently distributed in the horizontal direction meets a condition that one microphone of the pair of microphones belongs to the first microphone array and the other microphone belongs to the second microphone array, and the pair of microphones currently distributed in the perpendicular direction belongs to the first microphone array or the second microphone array;

performing differential processing on the selected voice signal collected by the pair of microphones distributed in the horizontal direction in order to obtain a first component of a first-order sound field;

performing differential processing on the selected voice signal collected by the pair of microphones distributed in the perpendicular direction in order to obtain a second component of the first-order sound field;

obtaining a component of a zero-order sound field by performing equalization processing on the plurality of voice signals corresponding to the current application mode; and generating, using the first component of the first-order sound field, the second component of the first-order sound field, and the component of the zero-order sound field, different beams whose beam directions are consistent with specific directions, wherein the predefined signal is a signal output by the accelerometer when the terminal is in a state of being placed perpendicularly or in a state of being placed horizontally, wherein the terminal in the state of being placed perpendicularly meets a condition that an angle between a longitudinal axis of the terminal and a horizontal plane is 90 degrees, and wherein the terminal in the state of being placed horizontally meets a condition that an angle between the longitudinal axis of the terminal and the horizontal plane is 0 degrees.

9. The method according to claim 1, wherein an accelerometer is disposed in the terminal, wherein, when the current application mode is the recording mode in the non-communication scenario, determining the plurality of voice signals corresponding to the current application mode comprises determining, according to the current application mode and from the at least two voice signals, voice signals currently collected by a pair of microphones that axe currently on a same horizontal line when the terminal is currently in a state of being placed perpendicularly or in a state of being placed horizontally, wherein the terminal in the state of being placed perpendicularly meets a condition that an angle between a longitudinal axis of the terminal and a horizontal plane is 90 degrees, and wherein the terminal in the state of being placed horizontally meets a condition that an angle between the longitudinal axis of the terminal and the horizontal plane is 0 degrees.

10. A voice signal processing apparatus, comprising:

a first microphone array that includes multiple microphones located at a bottom of a terminal;

a second microphone array that includes multiple microphones located at a top of a terminal;

a speaker located at the top of the terminal;

a memory; and a processor coupled to the memory, the first and second microphone arrays, and the speaker, and wherein the processor is configured to:

receive at least two voice signals collected by the first microphone array and the second microphone array;

determine a current application mode of the terminal, wherein the current application mode corresponds to a handheld calling mode, a video calling mode, a hands-free conferencing mode, or a recording mode in a non-communication scenario;

determine, according to the current application mode and from the at least two voice signals, a plurality of voice signals corresponding to the current application mode, wherein when the current application mode is the hands-free conferencing mode, the plurality of voice signals are determined by determining voice signals collected by the first microphone array and voice signals collected from the second microphone array; and after determining the plurality of voice signals corresponding to the current application mode, perform, in a preset voice signal processing manner that matches the current application mode, beamforming processing on the plurality of voice signals corresponding to the current application mode.

11. The apparatus according to claim 10, wherein the terminal further comprises an earpiece located on the top of the terminal, and wherein when the current application mode is the handheld calling mode, the processor is further configured to:

determine, according to the current application mode and from the at least two voice signals, the voice signals collected by the first microphone array and the voice signals collected by the second microphone array;

perform beamforming processing on the voice signals collected by the first microphone array such that a first beam generated after beamforming processing is performed on the voice signals collected by the first microphone array points to a direction directly in front of the bottom of the terminal; and perform beamforming processing on the voice signals collected by the second microphone array such that a second beam generated after beamforming processing is performed on the voice signals collected by the second microphone array points to a direction directly behind the top of the terminal, and wherein the second beam forms null steering in a direction in which the earpiece of the terminal is located.

12. The apparatus according to claim 10, wherein when the current application mode is the video calling mode, the processor is further configured to determine, according to the current application mode and from the at least two voice signals, the voice signals collected by the first microphone array when the terminal does not need to synthesize voice signals that have a stereophonic sound effect.

13. The apparatus according to claim 10, wherein an accelerometer is further disposed in the terminal, and wherein when the current application mode is the video calling mode, the processor is further configured to determine, from the at least two voice signals according to a signal output by the accelerometer, the plurality of voice signals corresponding to the current application mode when the terminal needs to synthesize voice signals that have a stereophonic sound effect.

14. The apparatus according to claim 13, wherein the processor is further configured to:

determine, from the at least two voice signals, voice signals currently collected by the second microphone array when the signal currently output by the accelerometer matches a predefined first signal, wherein the predefined first signal is the signal output by the accelerometer when the terminal is in a state of being placed perpendicularly, and wherein the terminal in the state of being placed perpendicularly meets a condition that an angle between a longitudinal axis of the terminal and a horizontal plane is 90 degrees; and determine, from the at least two voice signals, voice signals currently collected by specific microphones when the signal currently output by the accelerometer matches a predefined second signal, wherein the predefined second signal is the signal output by the accelerometer when the terminal is in a state of being placed horizontally, and wherein the terminal in the state of being placed horizontally meets a condition that an angle between the longitudinal axis of the terminal and the horizontal plane is 0 degrees, wherein the specific microphones comprise at least one pair of microphones that are on a same horizontal line when the terminal is in the state of being placed horizontally, and wherein each pair of microphones meets a condition that one microphone of the pair of microphones belongs to the first microphone array and the other microphone belongs to the second microphone array.

15. The apparatus according to claim 13, further comprising at least one camera coupled to the processor, and wherein the processor is further configured to:

determine a current status of each of the at least one camera; and perform, in the preset voice signal processing manner that matches both the current application mode and the current status of each of the at least one camera, beamforming processing on the plurality of voice signals corresponding to the current application mode.

16. The apparatus according to claim 10, wherein the processor is further configured to:

determine, according to a current sound effect mode of the terminal, whether the terminal needs to synthesize voice signals that have a surround sound effect;

determine a part of the terminal when the terminal does not need to synthesize voice signals that have the surround sound effect, wherein the part is currently used to play the voice signal;

perform beamforming processing on the plurality of voice signals corresponding to the current application mode such that a generated beam points to a location at which a common sound source of the plurality of voice signals corresponding to the current application mode is located, or a direction of the generated beam is consistent with a direction indicated by beam direction indication information entered into the terminal when the part is an earphone, wherein the location at which the common sound source is located is determined by performing, according to the plurality of voice signals corresponding to the current application mode, sound source tracking at the location at which the sound source is located; and perform beamforming processing on the plurality of voice signals corresponding to the current application mode such that the generated beam forms null steering in a direction in which the speaker is located when the part is the speaker.

17. The apparatus according to claim 16, wherein an accelerometer is disposed in the terminal, and wherein the processor is further configured to:

select, from the plurality of voice signals corresponding to the current application mode, a voice signal collected by each of a pair of microphones currently distributed in a horizontal direction and a voice signal collected by each of a pair of microphones currently distributed in a perpendicular direction when the terminal needs to synthesize voice signals that have the surround sound effect and when a signal currently output by the accelerometer matches a predefined signal, wherein the pair of microphones currently distributed in the horizontal direction meets a condition that one microphone of the pair of microphones belongs to the first microphone array and the other microphone belongs to the second microphone array, and wherein the pair of microphones currently distributed in the perpendicular direction belongs to the first microphone array or the second microphone array;

perform differential processing on the selected voice signal collected by each of the pair of microphones distributed in the horizontal direction in order to obtain a first component of a first-order sound field;

perform differential processing on the selected voice signal collected by each of the pair of microphones distributed in the perpendicular direction in order to obtain a second component of the first-order sound field;

obtain a component of a zero-order sound field by performing equalization processing on the plurality of voice signals corresponding to the current application mode; and generate, using the first component of the first-order sound field, the second component of the first-order sound field, and the component of the zero-order sound field, different beams whose beam directions are consistent with specific directions, wherein the predefined signal is a signal output by the accelerometer when the terminal is in a state of being placed perpendicularly or in a state of being placed horizontally, wherein the terminal in the state of being placed perpendicularly meets a condition that an angle between a longitudinal axis of the terminal and a horizontal plane is 90 degrees, and wherein the terminal in the state of being placed horizontally meets a condition that an angle between the longitudinal axis of the terminal and the horizontal plane is 0 degrees.

18. The apparatus according to claim 10, wherein an accelerometer is disposed in the terminal, and wherein when the current application mode is the recording mode in the non-communication scenario, the processor is further configured to determine, according to the current application mode and from the at least two voice signals, voice signals currently collected by a pair of microphones that are currently on a same horizontal line when the terminal is currently in a state of being placed perpendicularly or in a state of being placed horizontally, wherein the terminal in the state of being placed perpendicularly meets a condition that an angle between a longitudinal axis of the terminal and a horizontal plane is 90 degrees, and wherein the terminal in the state of being placed horizontally meets a condition that an angle between the longitudinal axis of the terminal and the horizontal plane is 0 degrees.

19. A voice signal processing method, comprising:

collecting, by a first microphone array and a second microphone array of a terminal, at least two voice signals, wherein the first microphone array comprises multiple microphones located at a bottom of the terminal, and wherein the second microphone array comprises multiple microphones located at the top of the terminal;

determining a current application mode of the terminal, wherein the current application mode corresponds to a handheld calling mode, a video calling mode, a hands-free conferencing mode, or a recording mode in a non-communication scenario;

determining, according to the current application mode and from the at least two voice signals, a plurality of voice signals corresponding to the current application mode, wherein when the current application mode is the video calling mode, determining the plurality of voice signals corresponding to the current application mode comprises determining voice signals collected by the first microphone array when the terminal does not need to synthesize voice signals that have a stereophonic sound effect; and after determining the plurality of voice signals corresponding to the current application mode, performing, in a preset voice signal processing manner that matches the current application mode, beamforming processing on the plurality of voice signals corresponding to the current application mode.

20. The method according to claim 19, wherein an accelerometer is further disposed in the terminal, and wherein when the current application mode is the video calling mode, determining the plurality of voice signals corresponding to the current application mode comprises determining, from the at least two voice signals according to a signal output by the accelerometer, the plurality of voice signals corresponding to the current application mode when the terminal needs to synthesize voice signals that have a stereophonic sound effect.

* * * * *